US007258399B2

(12) United States Patent
Neustat

(10) Patent No.: US 7,258,399 B2
(45) Date of Patent: Aug. 21, 2007

(54) SLIPCOVER WITH INTEGRATED PADDED AND DECORATIVE COMPONENT

(76) Inventor: Paula S Neustat, 10 London Ter., New City, NY (US) 10956

( * ) Notice: Subject to any disclaimer, the term of this patent is extended or adjusted under 35 U.S.C. 154(b) by 0 days.

(21) Appl. No.: 11/208,375

(22) Filed: Aug. 19, 2005

(65) Prior Publication Data

US 2007/0040424 A1 Feb. 22, 2007

(51) Int. Cl.

| | |
|---|---|
| ***A47C 31/11*** | (2006.01) |
| ***A47C 31/10*** | (2006.01) |
| ***A47C 31/00*** | (2006.01) |
| ***A47C 7/18*** | (2006.01) |
| ***A47C 7/24*** | (2006.01) |

(52) U.S. Cl. ..... 297/219.1; 297/218.2; 297/223; 297/225; 297/226; 297/228.1; 297/228.13; 297/452.27; 297/452.48; 297/DIG. 1

(58) Field of Classification Search ..... 297/219.1, 297/223, 225, 226, 228, 228.13, 228.1, 218.2, 297/452.48, 452.27, 452.26, DIG. 1
See application file for complete search history.

(56) References Cited

U.S. PATENT DOCUMENTS

| | | | | | |
|---|---|---|---|---|---|
| 1,717,121 | A | | 6/1929 | Sallop | 297/228 |
| 2,229,160 | A | * | 1/1941 | Wittcoff | 297/228.1 X |
| 2,546,109 | A | | 3/1951 | Puchalsky | 297/219.1 |
| 2,811,199 | A | | 10/1957 | Morrill et al. | 297/226 |
| RE24,805 | E | | 3/1960 | Morrill | 297/226 |
| 3,061,844 | A | * | 11/1962 | Coursey | 297/219.1 X |
| 3,080,195 | A | * | 3/1963 | Berg | 297/DIG. 1 X |
| 3,083,496 | A | * | 4/1963 | Feinerman | 297/452.48 X |
| 3,103,082 | A | * | 9/1963 | Baermann | 297/452.48 X |
| 3,109,474 | A | * | 11/1963 | Levi | 297/223 X |
| 3,270,394 | A | * | 9/1966 | Marsh et al. | 297/452.27 X |
| 3,298,047 | A | * | 1/1967 | Feinerman | 297/228.1 X |
| 3,371,957 | A | | 3/1968 | Cook | 297/225 |
| 3,515,430 | A | | 6/1970 | Nelson | 297/228.1 |
| 3,669,045 | A | | 6/1972 | Landoni | |
| 3,695,690 | A | | 10/1972 | Carson | |
| 3,972,565 | A | * | 8/1976 | Smith | 297/452.48 |
| 4,225,179 | A | | 9/1980 | Visconti | 297/219.1 |

(Continued)

OTHER PUBLICATIONS www.massage-chairs-direct.com, Massage Chairs Direct, accessed on Aug. 2, 2006.

(Continued)

*Primary Examiner*—Rodney B. White
(74) *Attorney, Agent, or Firm*—Fish & Neave IP Group Ropes & Gray LLP; Jeffrey H. Ingerman; Brian E. Mack

(57) ABSTRACT

Slipcovers are provided for covering a variety of seating structures. The slipcovers can include a fabric sheet, multi-layered components, extensions, anchors, relaxation mechanisms, and holders, and can be configured to cover all or a portion of a seating structure. The multi-layered components can be removably secured to the fabric sheet by decouplable fasteners or by friction or interaction with a friction enhancing material, non-removably secured to the fabric sheet by sewing, quilting, tufting, gluing, and/or applying an adhesive or bonding agent, or secured to the fabric sheet by extensions inserted into a crevice. The internal layers of a multi-layered component can also be removable, or a multi-layered component can be configured to allow additional layers to be inserted.

26 Claims, 27 Drawing Sheets

U.S. PATENT DOCUMENTS 4,514,869 A * 5/1985 Aoki et al. ..... 297/DIG. 1 X
4,563,785 A 1/1986 Samelson
4,676,376 A 6/1987 Keiswetter ..... 297/228.1 X
4,691,963 A * 9/1987 Mikuniya et al. ... 297/452.48 X
4,747,639 A 5/1988 Pfau ..... 297/219.1
4,750,714 A 6/1988 Kassai
4,761,032 A 8/1988 Sanchez et al.
4,776,636 A * 10/1988 Pyle et al. ..... 297/218.2 X
4,784,437 A * 11/1988 Shimada ..... 297/452.27 X
4,838,610 A 6/1989 Perrin ..... 297/225
4,891,454 A 1/1990 Perdelwitz et al.
4,892,769 A 1/1990 Perdelwitz et al.
5,093,947 A 3/1992 Henegar et al.
5,211,696 A 5/1993 Lacy
5,243,724 A 9/1993 Barnes
5,283,918 A * 2/1994 Weingartner et al. ..... 297/452.27 X
5,302,001 A * 4/1994 van Dis ..... 297/228.13
5,309,586 A 5/1994 Sies et al.
5,320,407 A 6/1994 Tell ..... 297/225 X
5,333,921 A 8/1994 Dinsmoor, III ..... 297/219.1
5,403,066 A 4/1995 Drum ..... 297/219.1
5,407,510 A 4/1995 Marfilius et al. .. 297/DIG. 1 X
5,423,098 A 6/1995 Swezey et al.
5,429,852 A * 7/1995 Quinn ..... 297/452.48 X
5,487,587 A 1/1996 Hylton ..... 297/219.1
5,494,330 A 2/1996 Fotsch ..... 297/219.1 X
5,547,249 A 8/1996 Riley et al. ..... 297/226 X
5,549,355 A 8/1996 Illulian ..... 297/225 X
5,557,815 A * 9/1996 Mintz et al. ..... 297/223 X
5,611,595 A 3/1997 Gatehouse
5,632,053 A * 5/1997 Weingartner et al. ..... 297/452.27 X
5,662,380 A 9/1997 Tam et al.
5,664,831 A 9/1997 White et al. ..... 297/225
5,664,832 A 9/1997 Stevens et al. ..... 297/225
5,722,723 A 3/1998 Riley et al. ..... 297/226 X
5,733,002 A 3/1998 Riley et al.
5,797,651 A 8/1998 Christa ..... 297/219.1 X
5,806,925 A 9/1998 Hanley ..... 297/219.1 X
5,906,878 A 5/1999 Horning et al. ..... 297/219.1 X
5,950,261 A 9/1999 Hay et al.
6,030,040 A 2/2000 Schmid et al. ..... 297/226 X
6,079,778 A 6/2000 Lindberg ..... 297/223
6,206,468 B1 3/2001 Brosnan et al. ..... 297/228.1
6,224,150 B1 5/2001 Eksin et al.
6,485,099 B2 11/2002 Illulian
6,485,100 B1 11/2002 Hitt ..... 297/219.1 X
6,648,410 B2 11/2003 Sparks ..... 297/228.1 X
6,659,550 B2 12/2003 Hackett ..... 297/228
6,659,551 B1 12/2003 Arenas ..... 297/219.1 X
6,676,210 B1 1/2004 Peyton
6,701,556 B2 3/2004 Romano et al. .... 297/452.27 X
6,796,609 B2 9/2004 Illulian ..... 297/219.1 X
6,929,325 B1 * 8/2005 Goelo ..... 297/219.1
7,000,984 B1 2/2006 Ward
2001/0048235 A1 12/2001 Hartranft
2003/0001416 A1 * 1/2003 Vanderminden ..... 297/219.1
2005/0146177 A1 * 7/2005 Jerome ..... 297/219.1
2005/0225134 A1 * 10/2005 Tseng ..... 297/219.1

OTHER PUBLICATIONS www.schukra.com, Schukra Lumbar Systems, accessed on Aug. 2, 2006.

www.relaxor.com, Welcome to InSeat Solutions, accessed on Aug. 2, 2006.

* cited by examiner

SLIPCOVER WITH INTEGRATED PADDED AND DECORATIVE COMPONENT

BACKGROUND OF THE INVENTION

The present invention relates generally to the field of furniture covers and, in particular, to slipcovers having new and useful constructions, arrangements, and components.

There are several kinds of slipcovers. Fitted slipcovers are used for covering a specific type of furniture with a specific shape, style, and size. Fitted slipcovers are constructed to fit the dimensions of the specific shape, size and style of the furniture to be covered. For example, for a fitted slipcover for a sofa, there are often multiple, separate parts including covers for separate seat cushions and/or back cushions sized to fit the specific cushion, frequently using a zipper closure to neatly enclose the cushion.

Semi-fitted slipcovers fit specific types of furniture (e.g., a sofa, a chair, an oversized chair, or a love seat, etc.) having a range of shapes, sizes, and styles. The semi-fitted slipcover is constructed to fit more than one specific shape, size, and style. Semi-fitted slipcovers are typically a one-piece unit that can be made of a variety of fabrics and materials as described in U.S. Pat. No. 5,664,832 and U.S. Pat. No. 6,796,609. U.S. Pat. No. 5,733,002 discloses an alternative two-piece slipcover having a shell and a lower skirt. In some cases, semi-fitted slipcovers can have multiple separate parts. For example, a semi-fitted slipcover for a sofa can have separate cushion covers like the fitted slipcover. However, unlike the fitted slipcover, the construction of the semi-fitted cover for a sofa cushion fits more than one specific cushion size. Another version of a semi-fitted slipcover is a-stretch slipcover in which the fabric is stretchable and can accommodate a range of seating structure sizes and shapes.

Semi-fitted slipcovers are loosely structured and oversized so that they can be adjusted to fit the contours of the particular furniture to be covered. Semi-fitted slipcovers for sofas are typically adjusted by tucking in extra fabric in certain locations such as between the seats and arms or seats and seat backs as disclosed in U.S. Pat. No. 5,664,831, U.S. Pat. No. 5,664,832, U.S. Pat. No. 6,485,099, and U.S. Pat. No. 6,796,609. Thus, semi-fitted slipcovers are structured to some degree in that they correspond to the contours of the furniture which they cover, but are sufficiently unstructured due to their dimensionless or bag-like portions.

Semi-fitted slipcovers are often formed from the sewing of multiple cloth pieces or panels. Elastics or sewing are sometimes used to provide structure to certain areas of a semi-fitted slipcover, as disclosed in U.S. Pat. No. 5,549,355. Structure is sometimes given to the arm portion of the semi-fitted slipcover which will be placed over the arms of the furniture, while the remainder of the semi-fitted slipcover is mostly unstructured.

One type of unfitted slipcover is known as a throw. This type of cover has minimal sewing or a complete lack of sewing. Throws can be applied to most types of seating structures because they are unstructured and are not made to fit specific parts of furniture. Throws can be used on many different sizes, shapes, and styles of seating structures. U.S. Pat. No. 4,838,610, U.S. Pat. Nos. 5,320,407, and 5,547,249 discuss the drawbacks of furniture throws in the background section, and are hereby incorporated herein by reference in their entirety. As explained in U.S. Pat. No. 5,547,249, after a throw cover has been loosely placed on a sofa, the user will hand tuck the fabric cover into the spaces between the seat cushion and the back and between the seat cushion and the arms at each side of the seating perimeter.

Often, it can be difficult for a consumer to determine which parts of a semi-fitted or unfitted slipcover correspond to which parts of a furniture because of the large size and unstructured or baggy areas of such slipcovers. Also, for fitted, semi-fitted, and unfitted slipcovers, a single layer of fabric used as a slipcover is not likely to provide any more comfort than the furniture it covers. Furthermore, semi-fitted and unfitted slipcovers also have the problem that excess fabric, which is initially tucked into the crevices of furniture, tends to become displaced and move around. Thus, for at least these reasons, there is continued interest in improving slipcovers to provide better convenience, protection, and comfort to a user.

SUMMARY OF THE INVENTION

As used herein, the term "fabric" will be used to refer generally to an assembly of one or more materials that can conform to different contours. A fabric can include materials that are resistant to liquid absorption or penetration, i.e., waterproof or water-resistant, materials that have a degree of friction that is resistant to movement, and/or materials that provide resistance and protection to ultraviolet radiation.

The disclosed slipcovers can be used to cover a variety of seating structures. A slipcover includes a fabric sheet that can be fitted, semi-fitted, or unfitted. The slipcover includes one or more multi-layered components that are secured to the fabric sheet. The multi-layered components may preferably include a top layer of fabric and a layer of cushioning material and can optionally include a bottom layer of fabric. The multi-layered components can be removably secured to the fabric sheet by decouplable fasteners such as zippers, buttons, snaps, ties, hooks, buckles, D-rings, clips, or hook-and-loop type fasteners such as those sold under the trademark VELCRO®. The fasteners can be attached to the fabric sheet, the multi-layered component, or both. The multi-layered components can also be non-removably secured to the fabric sheet by sewing, quilting, tufting, gluing, and/or applying an adhesive or bonding agent. Multi-layered components can be secured to portions of the fabric sheet corresponding to an arm portion, a back portion, a seat portion, a skirt portion, and/or a foot rest portion of a seating structure. Alternatively, a multi-layered component can be attached to an edge of the fabric sheet. The top layer, the layer of cushioning material, and/or the bottom layer can be secured to an edge of the fabric sheet. Alternatively, a multi-layered component can be secured to the fabric sheet from below the fabric sheet so that the layer of cushioning material is on the seating structure. A multi-layered component can be opened so that layers can be removed from or inserted into the multi-layered component.

In one aspect of the invention, a slipcover that includes a back multi-layered component and a seat multi-layered component can be configured to secure the multi-layered components to a fabric sheet so as to have a fabric sheet portion between the multi-layered components, such that the fabric sheet portion allows the back multi-layered component to rest upon the seat multi-layered component. The fabric sheet portion can be inserted into a crevice on the seating structure if one exists. Similarly, a slipcover that includes an arm multi-layered component and a seat multi-layered component can be configured to have a fabric sheet portion between them so as to allow the arm multi-layered portion to rest upon the seat multi-layered portion.

In one aspect of the invention, a slipcover can include a multi-layered component that does not completely cover the seating structure portion to which it corresponds. The multi-layered component can have a perimeter and the surface of the seating structure portion can have a boundary, and a section of the seating structure portion, i.e., a gap, can exist between the perimeter of the multi-layered component and the boundary of the seating structure portion. As disclosed, an extension can be used to create a fabric transition over the gap. In one embodiment, the extension can be a continuation of the top and/or bottom layers of fabric of the multi-layered component. In another embodiment, the extension can be a fabric section that is distinct from the multi-layered component and that can be secured to the multi-layered component by fasteners and/or by sewing, quilting, tufting, gluing, and/or applying an adhesive or bonding agent. An extension can be secured to the fabric sheet of a slipcover by fasteners and/or by sewing, quilting, tufting, and/or applying adhesives or a bonding agent. An extension can be secured to the fabric sheet of the slipcover by pressure and/or friction from being inserted into a crevice of a seating structure together with a portion of the fabric sheet, thereby also securing a multi-layered component to the fabric sheet. The extension can include the same and/or different materials from the top layer of fabric. An extension may or may not extend beyond the boundary of the seating structure portion.

In one aspect of the invention, a multi-layered component can include one or more relaxation mechanisms. A relaxation mechanism may be a massage mechanism, a heating mechanism, a lumbar support mechanism, or an audio mechanism capable of producing, for example, music or nature sounds. A relaxation mechanism can include a power regulator, a power connection, a compact battery, control circuitry, and relaxation components. A multi-layered component can include a grid of power and control connections that are connected to the relaxation mechanisms. In one embodiment, the relaxation mechanisms are lodged into the layer of cushioning material of a multi-layered component. In-one embodiment, the relaxation mechanisms can be removed from and inserted into a multi-layered component.

In one aspect of the invention, a slipcover can include a fabric sheet, a multi-layered component having a top layer of fabric and a layer of cushioning material, and holders secured to the multi-layered component, such as cup holders and remote control holders. The holders can be embedded in the layer of cushioning material in the multi-layered component or secured to the top layer of fabric of the multi-layered component.

In one aspect of the invention, a slipcover can include one or more anchors that can be lodged into a crevice of a seating structure. The anchors can be secured to the fabric sheet of the slipcover and/or to extensions. The anchors can be secured to an end portion or to a non-end portion of the fabric sheet or the extensions. The anchors and/or the fabric sheet and extensions can have fasteners for securing the anchors to the fabric sheet or extensions. The anchors can be secured to an end portion or a non-end portion of the fabric sheet or extensions by sewing, adhesives, and/or applying a bonding agent. An anchor can be configured to resist force or movement in a direction exiting the crevice, and can have, for example, a triangular cross-section, an L-shape, or a cylindrical shape. An anchor can also be partially or entirely compressible.

In one embodiment, a seating structure can be covered by a combination of slipcovers. Each slipcover can be configured to cover less than an entirety of a seating structure. In one embodiment, a slipcover can be configured to cover a one-user portion of a multi-user seating structure. In another embodiment, a slipcover can be configured to cover a two-user portion of a multi-user seating structure that accommodates more than two users.

BRIEF DESCRIPTION OF THE DRAWINGS

The above and other advantages of the invention will be apparent upon consideration of the following detailed description, taken in conjunction with the accompanying drawings, in which like reference characters refer to like parts throughout, and in which.

DETAILED DESCRIPTION OF THE INVENTION

U.S. patent application Ser. No. 11/050,948 contains related descriptions involving slipcovers and is hereby incorporated herein by reference in its entirety.

Figure 1:
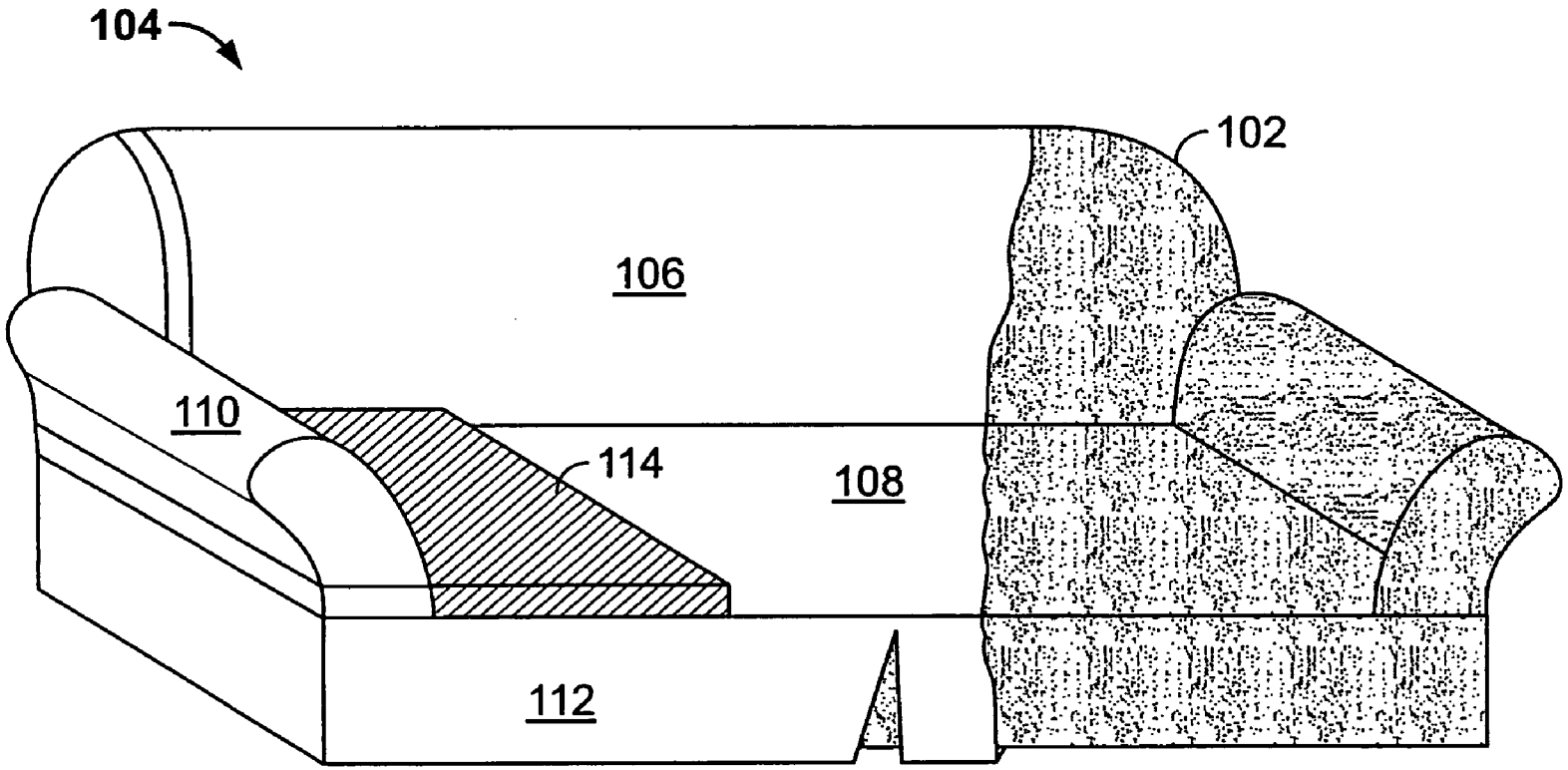
FIG. 1 is a diagram of one embodiment of a slipcover that includes multi-layered components corresponding to various portions of a seating structure.

Referring now to FIG. 1, there is shown a sofa 102 covered by a slipcover 104. The slipcover 104 includes a fabric sheet that has a back portion 106 which covers the front, back, and sides of the back of the furniture, a seat portion 108 which covers the top and front surfaces of the seating area of the furniture, a pair of arm portions 110 for covering the arms of the furniture, and a lower skirt portion 112. The lower skirt portion 112 may be a foot rest portion for seating structures that have a recliner feature.

The slipcover can be fitted, semi-fitted, or unfitted. In its fitted form, the slipcover is structured so that it fits precisely over the shape and size of the sofa. It may also have separate pieces that precisely fit the sofa cushions or other specific parts of the sofa. In its semi-fitted form, a portion of the slipcover, such as the back, seat, or arms, is structured while the remaining portions remain unstructured. A semi-fitted slipcover is preferably oversized with excess fabric that can be strategically tucked into the crevice regions of the sofa to achieve a fitted appearance despite the oversized and baggy nature of the semi-fitted slipcover. A semi-fitted slipcover may be one unit or may include multiple, separate pieces. In its unfitted form, the slipcover lacks structured regions altogether, allowing it to be strategically tucked into crevice regions to accommodate different types, sizes, shapes, and/or styles of seating structures and/or portions thereof. Such a slipcover is often called a "throw." The throw may be one unit or may include multiple, separate pieces. For slipcovers that have constructions in which extra fabric is located in the skirt area, the extra fabric can also be tucked into crevice regions or secured by fasteners such as ties, straps, D-rings, snaps, buttons, clips, and hook-and-loop type fasteners.

The term "fabric" as used herein refers generally to an assembly of one or more materials that can conform to different contours. A fabric can include one or more materials that are resistant to liquid penetration or absorption, i.e., waterproof or water-resistant, materials that have a degree of friction that is resistant to movement, materials that offer durability or resistance to abrasion, and/or materials that are resistant to bacteria, mold, stains, sunlight, and/or bleach.

Although a sofa is shown in FIG. 1, a slipcover according to the present invention can be used with any other type of seating furniture including, without limitation, chairs, loveseats, oversized chairs, arm chairs, wing chairs, rocking chairs, folding chairs, swivel chairs, ergonomic chairs, lounge chairs, task chairs, outdoor furniture, motion furniture, sofa beds, sectionals, ottomans, futons, floor cushions, seat cushions, outdoor furniture cushions, spa cushions, chaises, benches, bench cushions, day beds, recliners, dining room chairs, modular furniture, home theatre seating, sofas and chairs with one or no arms, or other forms of seating structures such as back rests, bean bags, seating with square cushion seats, seating with T-cushion seats, or soft, frameless furniture.

Referring again to FIG. 1, the slipcover 104 can include one or more multi-layered components 114. A multi-layered component contains at least a top layer of fabric and a layer of cushioning material that contains one or more cushioning materials such as cotton, polyester, silk, wool, various fabrics, fiberfill, or various types of foam that can include visco-elastic foam (also called "memory foam") of various heights, densities, qualities, and shapes. The layer of cushioning material can itself be wrapped in a fabric enclosure (not shown). Optionally, a multi-layered component can include a bottom layer of fabric. The top layer of fabric, the cushioning layer, and the optional bottom layer of fabric can be secured to each other by fasteners and/or by sewing, quilting, tufting, gluing, and/or applying one or more other bonding agents, for example. In turn, the multi-layered component 114 can also be secured to the fabric sheet of the slipcover 104 using fasteners and/or by sewing, quilting, tufting, and/or gluing. Alternatively, the multi-layered component 114 and the fabric sheet can be secured to each other by friction and/or by interaction with a friction-enhancing material.

If the multi-layered component 114 is secured to the fabric sheet by fasteners, the fabric sheet and the multi-layered component can each include fasteners that are attached thereto. The fasteners on the multi-layered component and the fasteners on the fabric sheet preferably are complementary so that they can interact with each other to secure the multi-layered component to the fabric sheet. For example and without limitation, fasteners can include decouplable devices such as zippers, buttons, snaps, straps, ties, hooks, buckles, D-rings, clips, and hook-and-loop type fasteners. If the multi-layered component is secured to the fabric sheet by sewing, quilting, tufting, gluing, and/or applying a bonding agent, the multi-layered component may not be detachable from the fabric sheet.

As explained in above-incorporated application Ser. No. 11/050,948, a slipcover can include multi-layered components in various quantities, configurations, and/or arrangements. For example, if a slipcover is substantially unstructured, one or more multi-layered components can be arranged with the fabric sheet in a way to serve as a guide for installing the slipcover. For example, multi-layered components can be secured to an arm portion, a back portion, a seat portion, a foot rest portion, and/or a skirt portion of a fabric sheet. A user installing such a slipcover can recognize the configuration of multi-layered components with the fabric sheet and can initially arrange the slipcover to place the multi-layered components over their corresponding parts on the furniture before installing the rest of the slipcover. Such a slipcover can have one multi-layered component or several multi-layered components. Additionally, although a fitted slipcover may also benefit from installation aides, they can also use multi-layered components in various manners and arrangements to enhance the comfort and protection of the furniture, for example.

Figure 2A:
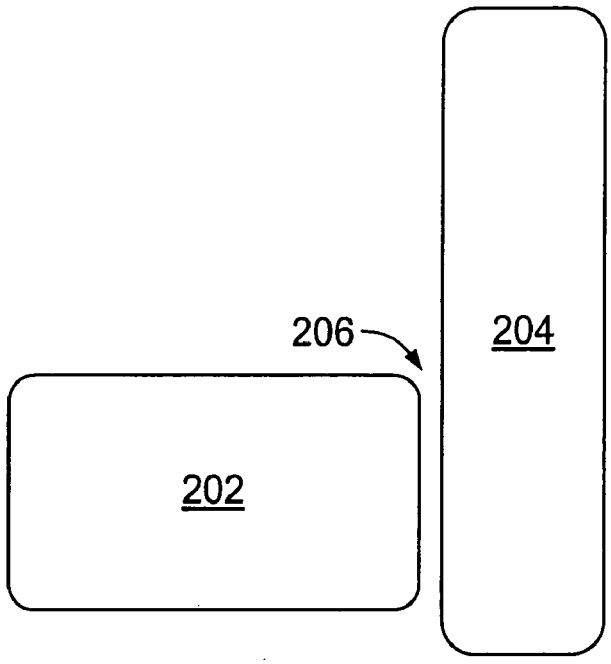
FIG. 2 is a diagram of a part of an exemplary seating structure that includes a crevice.

Various aspects of seating structures will now be described. FIG. 2A shows a cross-sectional view of a seating structure that includes a seating structure portion 202 and an adjoining portion 204 that is adjacent to the seating structure portion 202. The seating structure portion 202 and the adjoining portion 204 can be a seat portion and a back portion, a seat portion and an arm portion, or a back portion and an arm portion of a seating structure, for example. There is a crevice 206 between the seating structure portion and the adjoining portion of the seating structure. The seating structure portion 202 and the adjoining portion 204 are often flush against each other so that the crevice 206 often is not an open space. However, an open space may be illustrated herein for purposes of describing aspects of the invention.

Figure 2B:
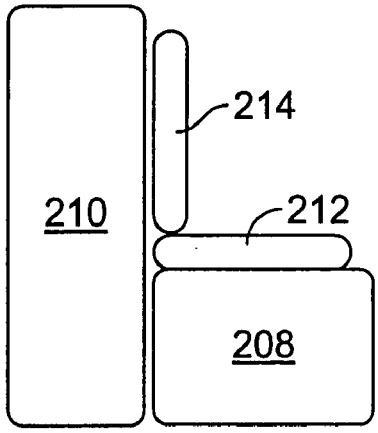

The arrangement of FIG. 2A is exemplary, and it will be understood that a crevice can be formed between any number of seating structure portions and may have many different shapes depending on the arrangement of the seating structure portions. For example, FIG. 2B shows an arrangement that includes a seating structure portion 208, an adjoining portion 210, a cushion 212 against the seating structure portion, and a cushion 214 against the adjoining portion. This arrangement creates one or more crevices that may have different shapes from the crevice 206 of FIG. 2A. Additionally, it will be understood that the proportions and relative sizes of the illustrated structures may or may not be drawn to scale. From hereon, particular seating structure arrangements and crevices may be used to explain other aspects of the invention herein, without limiting the contemplated arrangement and shapes of the seating structure portions and crevices. Importantly, the arrangements and crevices shown in the illustrations herein are exemplary and are not limiting.

Various aspects of multi-layered components will now be described.

Figure 3A:
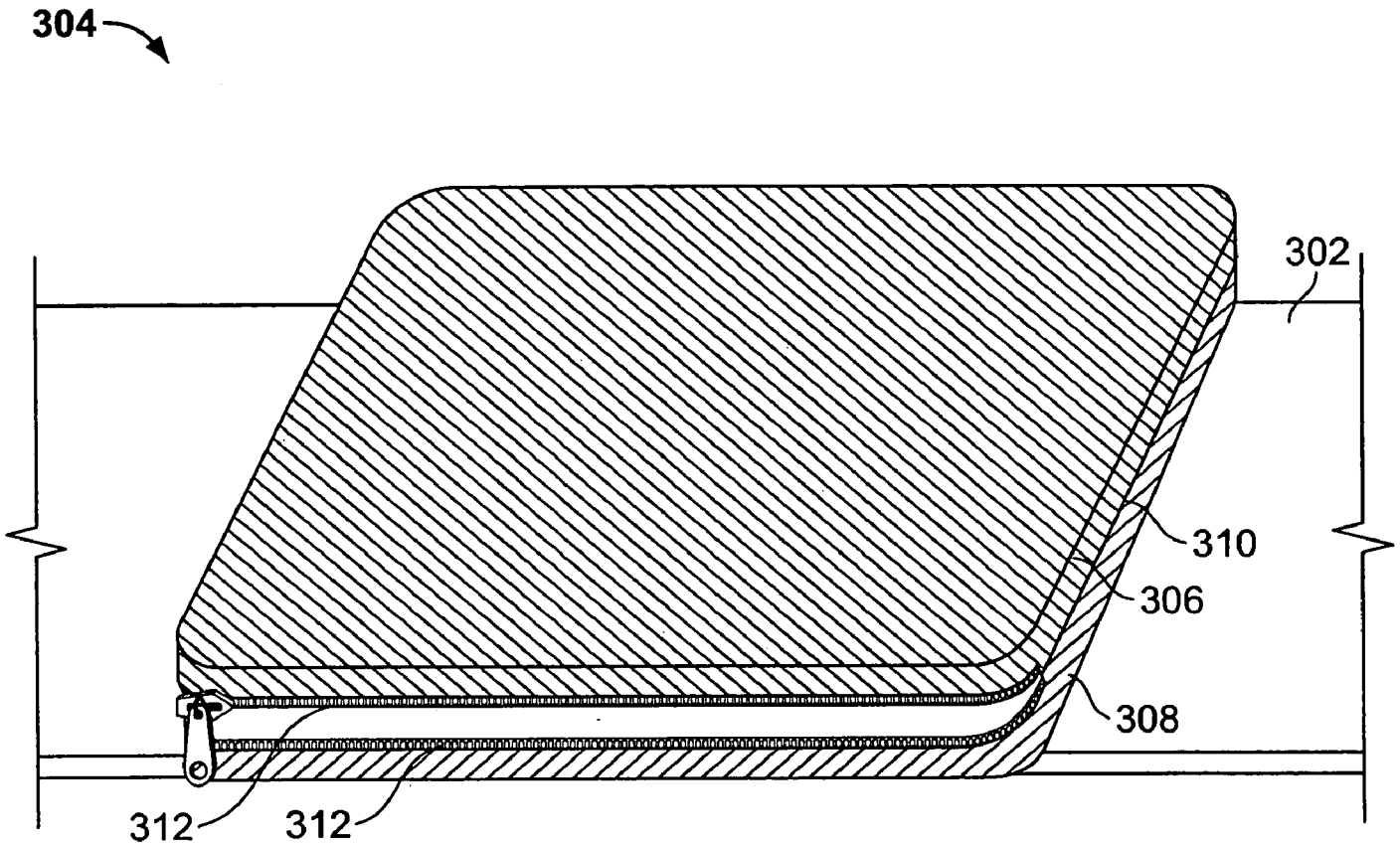
FIG. 3 is a diagram of an exemplary multi-layered component that can be opened to access the interior of the multi-layered component.

In accordance with one aspect of the invention, a slipcover may include one or more multi-layered components having layers that are insertable or removable. FIG. 3A shows one embodiment of a slipcover that includes a fabric sheet 302 and a multi-layered component 304 that has a top layer of fabric 306 and a bottom layer of fabric 308. The fabric sheet 302 can be secured to the bottom layer of fabric 308 by fasteners and/or by sewing, tufting, quilting, and/or applying glue or a bonding agent (not shown). Alternatively, the bottom layer of fabric can be secured to the fabric sheet by friction only and/or by interaction with a friction enhancing material (not shown), such as rubber. The friction enhancing material can be between the bottom layer of fabric and the fabric sheet so that it interacts with both. In the illustration, the top and bottom layers of fabric 306,308 are secured to each other at several portions of the perimeter 310 by sewing. At the remaining, un-sewn portion, the top and bottom layers of fabric can be coupled or decoupled from each other by a zipper fastener 312, thereby allowing access to one or more layers within the multi-layered component 304. The one or more layers within the multi-layered component 304 are not themselves secured to the top layer of fabric 306 or the bottom layer of fabric 308 and can be removed or replaced. Additional layers of cushioning material can be inserted into the multi-layered component 304 to enhance comfort. The inserted layer of cushioning materials can be composed of a softer cushioning material, such as visco-elastic memory foam of different grades, qualities, densities, heights, and shapes, for example. Also, layers inside the multi-layered component 304 can be removed to allow the multi-layered component 304 to be washed and cleaned, and the layers can be reinserted. Also, replacement layers of cushioning material can be inserted into the multi-layered component 304 if the existing layer is worn or if new material is desired or for any other reason.

The illustrated embodiment of FIG. 3A is merely exemplary and does not limit the scope of the invention. For example, the top and bottom layers of fabric need not be secured to each other by sewing, the zipper can traverse the entire perimeter of the multi-layered component, and fasteners other than zippers can be used. Also, multi-layered component need not include a bottom layer of fabric. Rather, the top layer of fabric can be secured to the fabric sheet at the perimeter of the multi-layered component, which is along the shape or contour of the multi-layered component. In other embodiments, the fabric sheet can be "above", the multi-layered component such that the multi-layered component is between the fabric sheet and the seating structure. In such an embodiment, the fabric sheet can be secured to the top layer of fabric and/or the layer of cushioning material by fasteners and/or by sewing, tufting, quilting, and/or applying glue or a bonding agent. Therefore, the illustration in FIG. 3A may be an angled, bottom-up view in which the fabric sheet 302 is above the multi-layered component 304. In such an embodiment, the multi-layered component 304 may have a bottom layer of fabric and may not have a top layer of fabric. Alternatively, in one embodiment, a multi-layered component may be only one or more layers of cushioning material without a top layer of fabric or a bottom layer of fabric. Such a multi-layered component can be secured to the fabric sheet from above or below the fabric sheet.

Figure 3B:
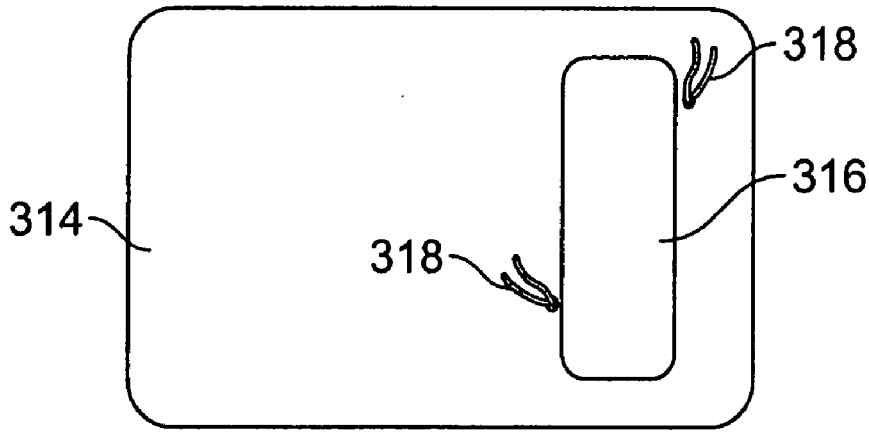

In one aspect as explained in above-incorporated application Ser. No. 11/050,948, a multi-layered component may replace a portion of a fabric sheet. For example, as shown in FIG. 3B, a fabric sheet 314 can include a hole 316 at a portion of the fabric sheet. A multi-layered component (not shown) can cover the hole 316 of the fabric sheet by being secured to the fabric sheet 314. For example, the multi-layered component can be secured to the fabric sheet 314 using fasteners 318. Additionally, the multi-layered component can be secured to the fabric sheet 314 by sewing, tufting, quilting, and/or applying an adhesive or bonding agent (not shown). A multi-layered component covering the hole 316 need not exactly fit the dimensions of the hole 316.

Figure 3C:
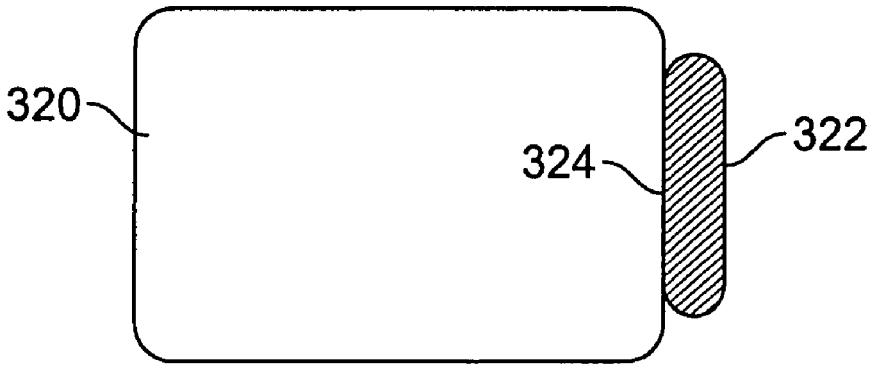

In general, a multi-layered component of different sizes and shapes can be used with fabric sheets of different sizes and shapes. Also, the multi-layered component can be secured to the fabric sheet at various locations on the fabric sheet. In one aspect of the disclosed invention, with reference to FIG. 3C, a fabric sheet 320 can be secured to a multi-layered component 322 at or near an edge 324 of the fabric sheet, so that at least a portion of the multi-layered component 322 is outside an edge 324 of the fabric sheet 320. The multi-layered component 322 and the fabric sheet 320 may be secured to each other by fasteners (not shown) and/or by sewing, tufting, quilting, and/or applying an adhesive or bonding agent (not shown).

In one aspect as explained in above-incorporated application Ser. No. 11/050,948, the perimeters of the multi-layered component and/or the layer of cushioning material can have shaped edges, such as a rounded edge, a pointed edge, a box edge, a square edge, and an angled edge. The perimeters can include more than one shaped edge along portions of the perimeters. For example, referring again to FIG. 3C, the multi-layered component 322 can have a shaped edge 324 that is, for example, a pointed edge. The fabric sheet 320 can be secured to the edge 324 of the multi-layered component 322. If the edge is raised, then the fabric sheet may not be entirely in contact with a seating structure that is covered.

It will be understood that the aspects of the invention relating to slipcovers and multi-layered components disclosed herein and/or aspects described in above-incorporated application Ser. No. 11/050,948 are generally applicable to slipcovers. Accordingly, although particular embodiments of slipcovers and multi-layered components may be illustrated herein, the illustrations are exemplary and other embodiments of slipcovers and multi-layered components in accordance with the disclosed aspects can also be used.

Figure 4:
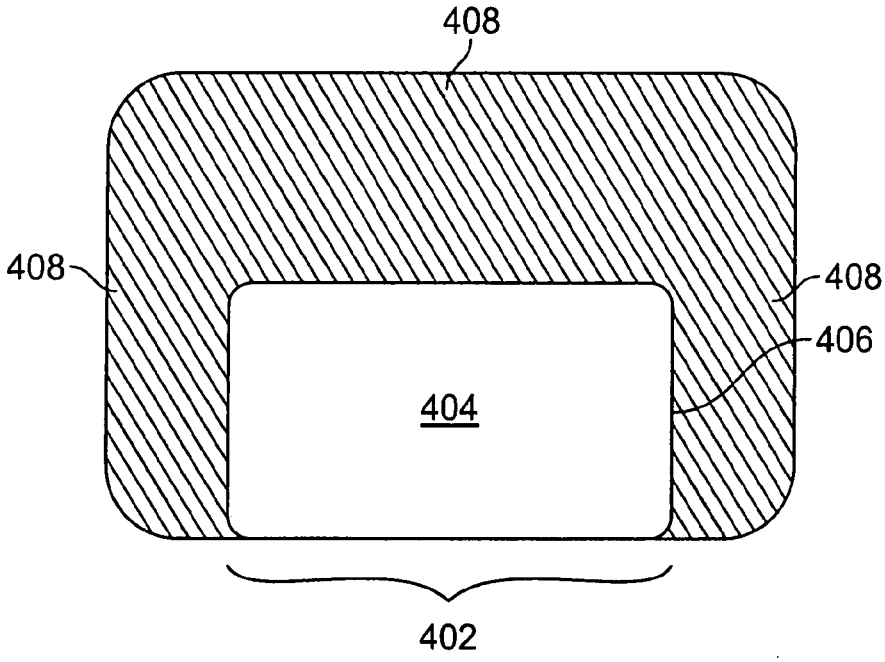
FIG. 4 is a diagram of a bottom-up view of one embodiment of an extension.

One aspect of the disclosed invention may be referred to herein as "extensions," and will be explained with reference to FIGS. 4-10. FIG. 4 shows a two-dimensional, bottom-up view of a multi-layered component 402 having a layer of cushioning material 404 and a top layer of fabric. The top layer of fabric in the illustration is behind the layer of cushioning material and is obscured from view. However, the top layer of fabric can generally include various visual characteristics such as color, luster, adornments, decorations, and patterns, and can additionally include various contact characteristics such as texture and thickness. Decorations can include decorative quilting, tufting, and covered buttons. The layer of cushioning material 404 preferably includes cushioning materials such as cotton and/or foam and can have various thicknesses depending on the type and amount of cushioning material, although this thickness dimension is not shown in the illustration. The layer of cushioning material 404 can have a recognizable perimeter 406 that corresponds to the shape and/or contour of the layer of cushioning material, and that also defines the perimeter of the multi-layered component 402 as a whole. Extensions may refer to fabric sections that extend beyond the perimeter of the multi-layered component and that may be the same or distinct from the layers of fabric of a multi-layered component. Accordingly, the fabric sections 408 in FIG. 4 that extend beyond the perimeter of the layer of cushioning material may be considered extensions.

Figure 5:
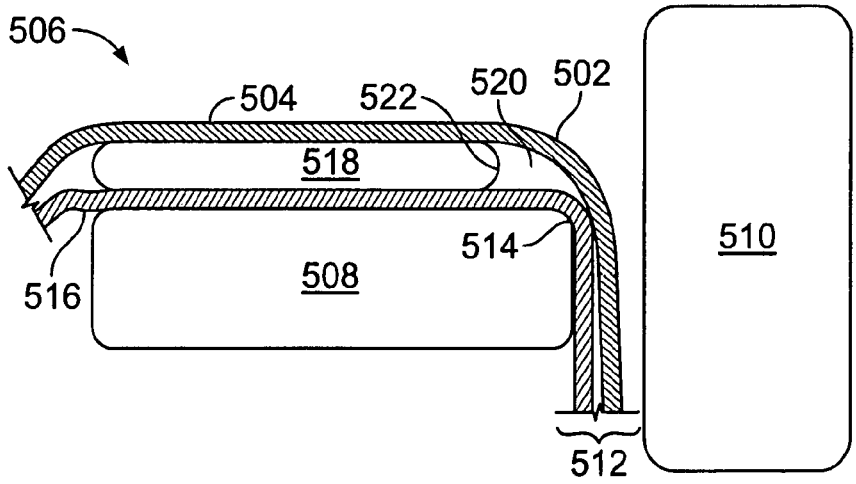
FIG. 5 is a diagram of one embodiment of an extension that is a continuation of the top layer of fabric of a multi-layered component.

FIG. 5 shows one embodiment of an extension in which the extension 502 is a continuation of the top layer of fabric 504 in the multi-layered component 506. The illustration shows a cross-sectional view of parts of a seating structure, such as a sofa, that include a seating structure portion 508, an adjoining portion 510, and a crevice 512 between the portions. The edges of the surface of seating structure portion 508 will be referred to herein as a "boundary" 514 of the seating structure portion. The slipcover covering the seating structure in this embodiment preferably includes a fabric sheet 516 and a multi-layered component 506. The multi-layered component 506 in the illustrated embodiment includes only a layer of cushioning material 518 and a top layer of fabric 504.

As shown in the illustration, the multi-layered component 506 does not completely cover the seating structure portion 508, so that there is a section of the seating structure portion, i.e., a gap 520, between the perimeter 522 of the multi-layered component and the boundary 514 of the seating structure portion. This can happen even when the multi-layered component 506 is available in different sizes because no one size may perfectly fit the seating structure portion 508. Because the multi-layered component 506 has thickness and has a raised appearance above the surface of the seating structure portion, the appearance of a gap 520 between the perimeter of the multi-layered component and the boundary of the seating structure portion can be abrupt and unsightly. However, because an extension 502 extends beyond the perimeter 522 of the multi-layered component, it can be used to mitigate the abrupt appearance of the gap 520 by creating a gradual fabric transition over the gap 520. For example, the extension 502 can be pulled taut over the gap 520 and then tucked into the crevice 512 to provide an angled fabric portion over the gap 520. When an extension 502 is tucked into the crevice, it provides the benefit of helping to secure the slipcover to the seating structure by friction and pressure within the crevice. Alternatively, on seating structures with a crevice, the extensions can be secured to the fabric sheet before the boundary or within the crevice by fasteners or by sewing, quilting, tufting, and/or applying a bonding agent. Alternatively, on seating structures without a crevice, the extensions can be secured to the fabric sheet before the boundary or past the boundary (not shown) by fasteners or by sewing, quilting, tufting, and/or applying adhesives. For this reason, an extension can be particularly helpful to secure the multi-layered component to fabric sheets of slipcovers for many types of seating structures.

In the illustrated embodiment of FIG. 5, the layer of cushioning material 518 is not secured to either the top layer of fabric 504 or the fabric sheet 516. Rather, the extension 502 and an end portion of fabric sheet 516 are inserted into the crevice 512, and pressure and friction within the crevice 512 operate to secure the extension to the fabric sheet 516. Because the extension 502 is a continuation of the top layer of fabric 504, pressure and friction within the crevice also operate to secure the multi-layered component 506 to the fabric sheet 516. Advantageously, the top layer of fabric 504 can be removed from the crevice 512 to provide access to the interior of the multi-layered component 506.

The illustrated embodiment in FIG. 5 is exemplary. In other contemplated embodiments, the layer of cushioning material in a multi-layered component can be secured to the top layer of fabric and/or the fabric sheet. Also, the top layer of fabric can additionally be secured to the fabric sheet by fasteners and/or by sewing, tufting, quilting, and/or by applying glue or a bonding agent, for example.

Figure 6:
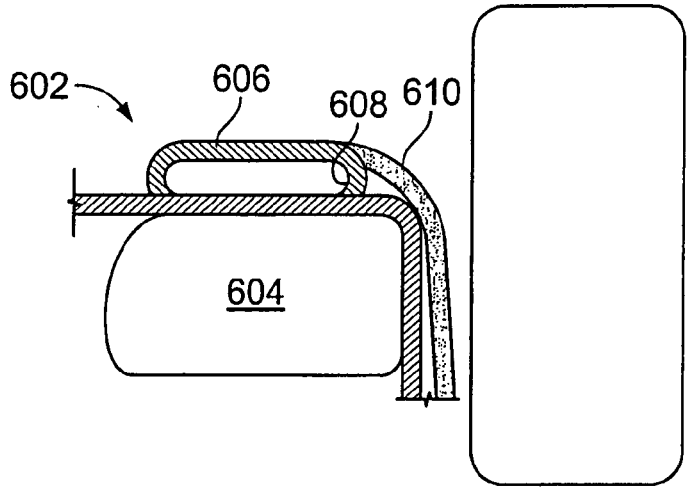
FIG. 6 is a diagram of one embodiment of an extension that is distinct from the multi-layered component.
Figure 7:
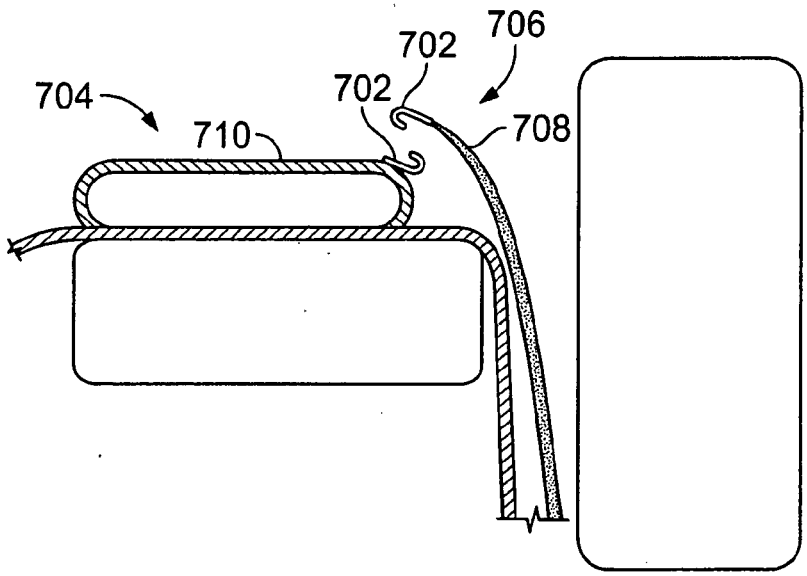
FIG. 7 is a variation of FIG. 6 in which the extension and the multi-layered component have fasteners.

FIGS. 6-7 show embodiments of an extension in which the extension is distinct from the multi-layered component. As before, the multi-layered component 602 of the slipcover does not completely cover the seating structure portion 604. The top layer of fabric 606 in the illustrated embodiment does not extend beyond the perimeter 608 of the multi-layered component. Instead, a distinct extension 610 can be secured to the multi-layered component 602. In the embodiment of FIG. 6, the extension 610 is secured to the multi-layered component 602 by sewing, quilting, tufting, and/or applying an adhesive or bonding agent (not shown). Such an extension would not be readily removable from the multi-layered component. In the embodiment of FIG. 7, the extension can be secured to the top layer of fabric by fasteners 702 attached to the multi-layered component 704. The fasteners 702 can be decouplable fasteners such as zippers, buttons, snaps, ties, hooks, buckles, D-rings, clips, or hook-and-loop type fasteners, among others. The extension 706 in the illustrated embodiment includes a fabric section 708 that can have the same appearance as the top layer of fabric 710 or a different appearance. For example, the fabric section 708 can have the same or different color, construction, composition, weave, luster, adornments, decorations, and/or patterns as that of the top layer of fabric 710. Additionally, the fabric section 708 can have the same or different texture, weight, and/or thickness as that of the top layer of fabric 710. The fabric section 708 has one or more fasteners 702 that can interact with the fasteners 702 on the multi-layered component 704. As shown in the illustration, the fasteners 702 can be hooks. The extension 706 can be secured to the multi-layered component 704 by coupling the hooks 702. Then, by decoupling the hooks 702, the extension 706 can be removed from the multi-layered component 704.

Figure 8:
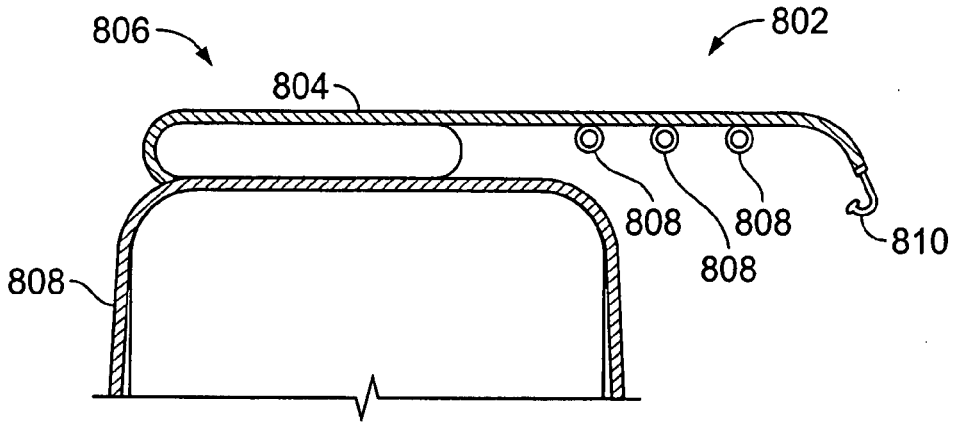
FIG. 8 is a diagram of one embodiment of an extension in which the size of the extension is adjustable.

FIG. 8 shows another embodiment of an extension in which the size of the extension is adjustable. In the illustrated embodiment, the extension 802 is a continuation of the top layer of fabric 804 of the multi-layered component 806. The extension 8,02 includes one or more fasteners 808, such as loops, attached to various locations on the extension, and another fastener 810, such as a hook, attached to an end portion of the extension. Other types of fasteners that can be used here are ties, buttons, snaps, or another type of fastener. The extension 802 can be "folded" and maintained in a folded configuration by coupling the hook fastener 810 to a loop fastener 808. The hook fastener 810 can be coupled to different loop fasteners 808 located at various locations on the extension 802, thereby adjusting the location of the fold and the size of the extension 802. The multi-layered component 806 can be secured to the fabric sheet 808 in the manners previously described herein.

Figure 9:
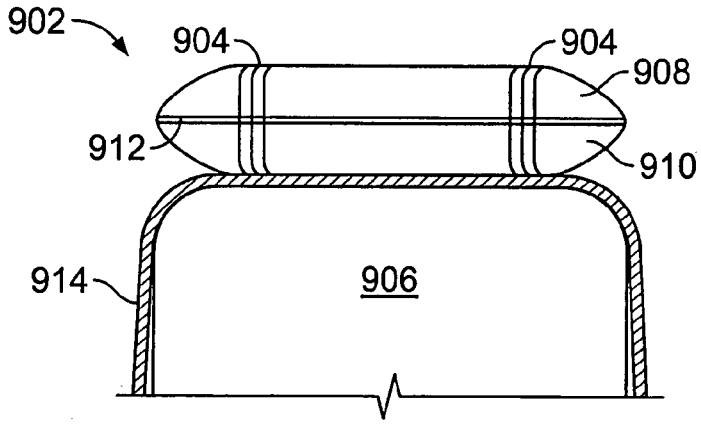
FIG. 9 is a diagram of one embodiment of an extension in which the extension includes both the top layer of fabric and the bottom layer of fabric of a multi-layered component.
Figure 10:
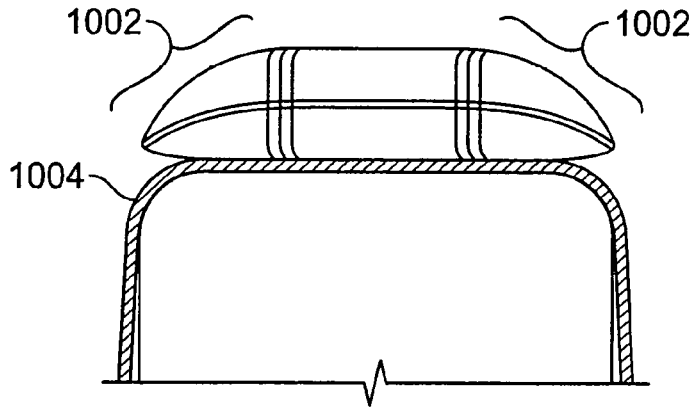
FIG. 10 is a variation of FIG. 9 in which the extension is crumpled.

FIGS. 9-10 show yet other embodiments of an extension in which the extension is formed by continuations of both a top layer of fabric and a bottom layer of fabric of a multi-layered component. Referring to FIGS. 9 and 10, the multi-layered component 902 includes a layer of cushioning material (not shown) that has a recognizable perimeter 904 and that does not completely cover the seating structure portion 906. The top layer of fabric 908 and the bottom layer of fabric 910 both extend beyond the perimeter 904 of the multi-layered component and are secured to each other in a way that creates a seam 912. The seam 912 can have the appearance of a knife edge, corded edge, piped edge, welted edge, or box edge. The top and bottom layers of fabric 908,910 can be secured to each other by fasteners and/or by sewing, quilting, tufting, and/or applying an adhesive or bonding agent (not shown). In the embodiment of FIG. 9, the top layer of fabric 908 and the bottom layer of fabric 910 have sufficient sturdiness to resist the downward pull of gravity and can maintain a particular shape. As shown, the extensions do not crumple onto the fabric sheet 914 and the seam 912 remains substantially level around the multi-layered component 902. In another embodiment shown in FIG. 10, the extensions 1002 are "crumpled" onto the fabric sheet 1004. If the extensions 1002 have sufficient sturdiness to resist the downward pull of gravity, then the extensions can be crumpled onto the fabric sheet 1004 by human force. If the extensions 1002 do not have sufficient sturdiness, then they can crumple onto the fabric sheet by the force of gravity alone. In both FIGS. 9 and 10, the extensions still operate to mitigate the unsightliness of the gap, as before, and may or may not extend beyond the boundary of the seating structure portion.

The illustrations in FIGS. 4-10 are exemplary and should not be construed to limit the disclosed invention. For example, although the illustrations show extensions on a portion of the perimeter of a multi-layered component, it will be understood that one or more extensions can be used around the entire perimeter of a multi-layered component. Additionally, one or more extensions can be used on adjacent or non-adjacent, or continuous or non-continuous portions of the perimeter.

Another aspect of the invention may be referred to as an "anchor." An anchor may be an object that can be lodged into a crevice of a seating structure and that is configured to resist force and/or movement in a direction exiting the crevice. FIGS. 11-14 show embodiments of an anchor that is lodged into a crevice of a seating structure, FIGS. 15-17 show embodiments of a cylindrical anchor, and FIGS. 18-21 show embodiments of a slipcover that includes an anchor.

Figure 11:
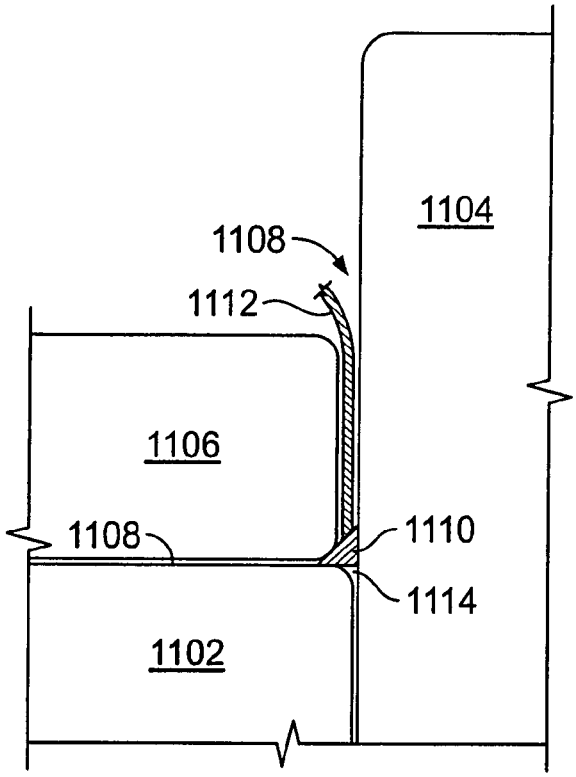
FIG. 11 is a diagram of one embodiment of an anchor in which the anchor has a triangular cross section.

Referring now to FIG. 11, there is shown a seating structure portion 1102, an adjoining portion 1104, a cushion 1106, and crevices 1108 between the cushion and the adjoining portion and between the cushion and the seating structure portion. In some cases, the crevice between the cushion and the seating structure portion may be partially or completely closed and may not be accessible because the cushion 1106 may be irremovably secured to the seating structure portion 1102. Additionally, the crevice can include a pocket of space 1114 where the anchor 1110 can be positioned. Depending on the size and shape of the anchor 1110, the cushion 1106 may or may not be compressed from pressing against the anchor 1110. The illustrated anchor 1110 has a triangular cross section that is preferably a right triangle, and a depth dimension that is not shown. The object 1112 that is secured to the anchor 1110 can be a fabric sheet or a fastener. As shown, the anchor 1110 is lodged into the crevice 1108 and the cushion 1106 is settled around the anchor. In the illustrated embodiment, the anchor fits into the pocket of space 1114 and does not cause the cushion 1106 to compress. A force applied to the anchor 1110 in a direction exiting the crevice 1108 would cause the anchor 1108 to push against the cushion 1106 and/or the adjoining portion 1104, thereby resulting in resistance to the force exiting the crevice. The anchor may push against the cushion 1106 and/or the adjoining portion 1104 because, for example, the crevice 1108 may be very "tight," and the anchor 1110 may experience resistance when attempting to move through the tight crevice 1108. Accordingly, a fabric sheet or another object 1112 that is secured to the anchor 1110 can be maintained substantially in place.

Figure 12:
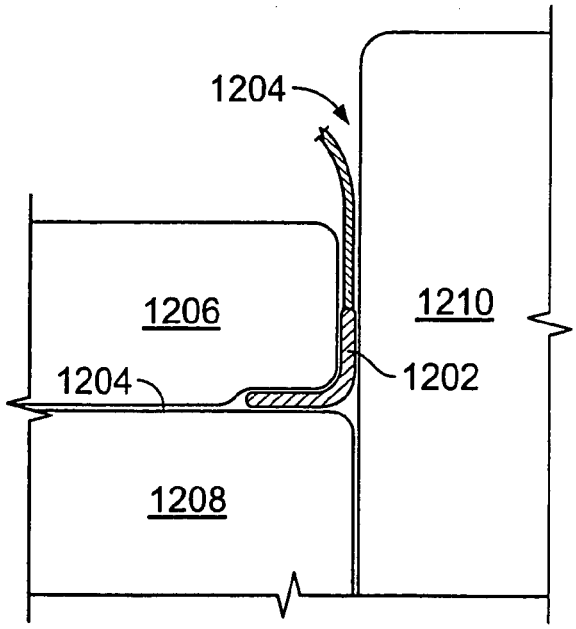
FIG. 12 is a diagram of one embodiment of an anchor in which the anchor has an L-shape.

FIG. 12 shows an embodiment of an anchor that has an L-shape. This anchor 1202 can be similar to a polycarbonate corner guard that can be approximately one to two inches for each leg of the L-shape. As before, the depth dimension is not shown. When lodged into the crevice 1204, one leg of the anchor 1202 can be positioned between the cushion 1206 and the seating structure portion 1208, and the other leg of the anchor 1202 can be positioned between the cushion 1206 and the adjoining portion 1210. As before, a force applied to the anchor 1202 in a direction exiting the crevice 1204 would cause the anchor 1202 to push against the cushion 1206 and/or the adjoining portion 1210, thereby resulting in resistance to the force exiting the crevice 1204. The anchor may push against the cushion 1206 and/or the adjoining portion 1210 because, for example, the crevice 1204 may be very "tight," and the anchor 1202 may experience resistance when attempting to move through the tight crevice 1204.

Figure 13:
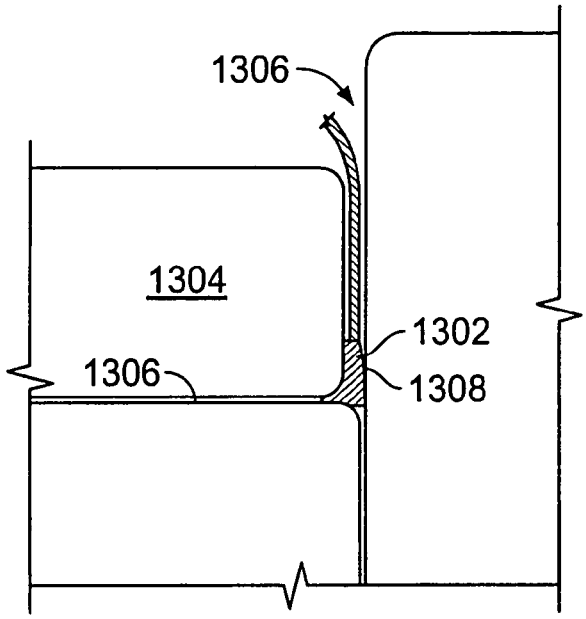
FIG. 13 is a diagram of one embodiment of an anchor in which the anchor is a partially compressible sphere.

FIG. 13 shows an embodiment of an anchor in which the anchor is composed of compressible material. As shown, the anchor 1302 is compressed as it is inserted into the crevice 1306 before it is lodged in the pocket of space 1308. When it reaches the pocket of space 1308, the anchor 1302 then expands to fill that space. In one embodiment, the anchor 1302 can be a sphere when it is not compressed. Such an anchor operates in the same manner as other anchors previously disclosed herein and resists a force in direction exiting the crevice 1306.

Figure 14:
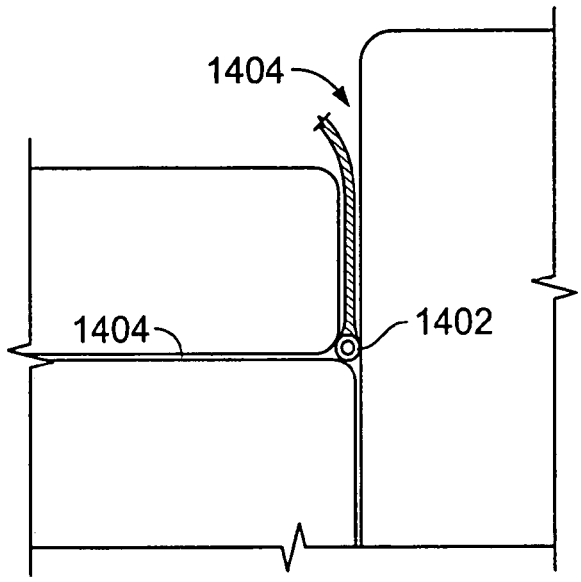
FIG. 14 is a diagram of one embodiment of an anchor in which the anchor has a cylindrical shape and includes a fastener.
Figure 15:
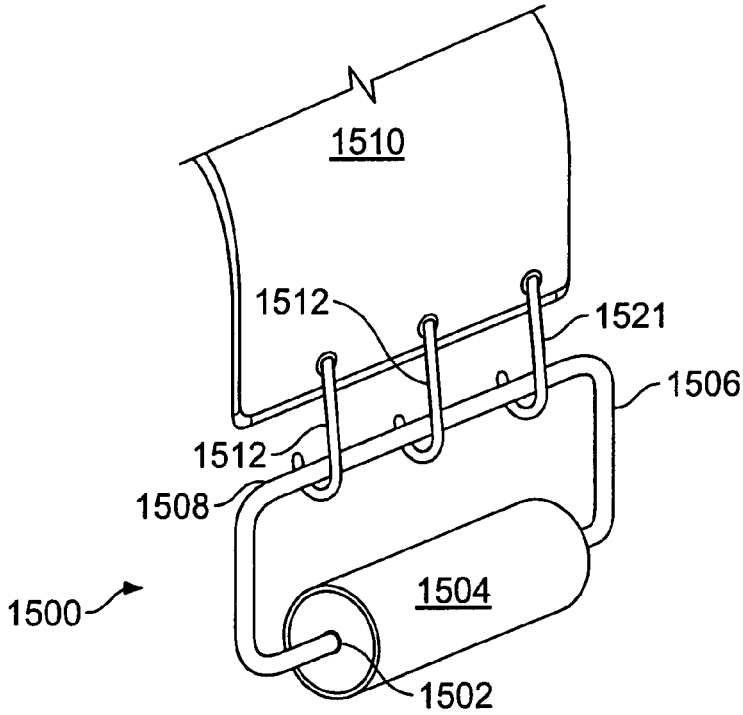
FIG. 15 is a diagram of one embodiment of a cylindrical anchor in which the anchor is secured by hook fasteners.
Figure 16:
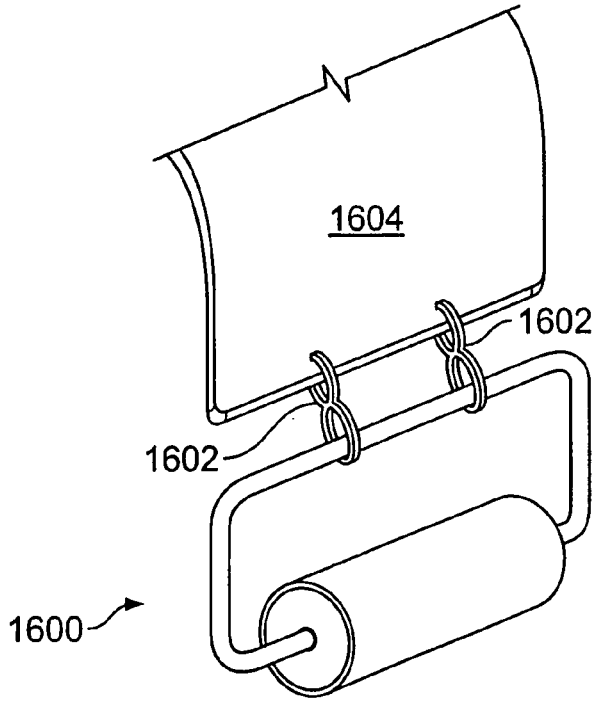
FIG. 16 is a diagram of one embodiment of a cylindrical anchor in which the anchor is secured by clip fasteners.
Figure 17:
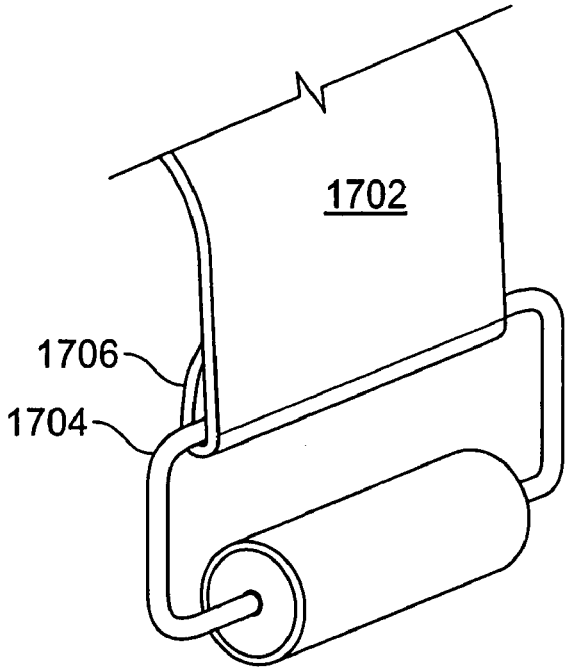
FIG. 17 is a diagram of one embodiment of a cylindrical anchor in which the anchor is secured to a loop of fabric.

FIGS. 14-17 show embodiments of an anchor in which the anchor has a cylindrical shape and includes one or more fasteners. FIG. 14 shows the anchor 1402 lodged within a crevice 1404. Referring also to FIG. 15, the anchor 1500 includes a tube of space 1502 along the axis of the cylinder 1504, which contains a portion of a fastener 1506. The tube of space 1502 and the fastener 1506 are configured to allow the cylinder 1504 to rotate about its axis. This rotation can allow the cylindrical anchor 1500 to be more easily inserted into a crevice by rolling. As illustrated, the fastener 1506 can also include a section 1508 outside the cylinder 1504 that extends substantially parallel to the axis of the cylinder 1504, which can be used to interact with a fabric sheet and/or an extension, and/or with fasteners. In various embodiments, the diameter of a cylinder can range from about one inch to six inches, and the length of the cylinder can range from about three inches to thirty inches. FIG. 15 shows an embodiment in which a fabric sheet or extension 1510 includes hook fasteners 1512 that can couple to the fastener section 1508 outside the cylinder 1504. FIG. 16 shows another embodiment in which the cylindrical anchor 1600 also includes clip fasteners 1602 that have tension prongs for gripping onto a fabric sheet or extension 1604. FIG. 17 shows another embodiment in which a fabric sheet or extension 1702 is secured to the fastener 1704 on the anchor by a loop 1706. The loop 1706 can be formed, for example, by an adjustable extension as shown in FIG. 8.

From hereon, the described embodiments will assume that the anchor has a triangular cross-section, although another anchor in accordance with the principles of the disclosed invention can be used. Also, it will be assumed that the anchor has an attached fastener, which can be one or more of the fasteners shown in FIGS. 15-17 or another fastener that is not shown. Alternatively, the anchor can be non-removably secured to a fabric sheet and/or an extension by sewing, quilting, tufting, and/or applying an adhesive or bonding agent.

Figure 18:
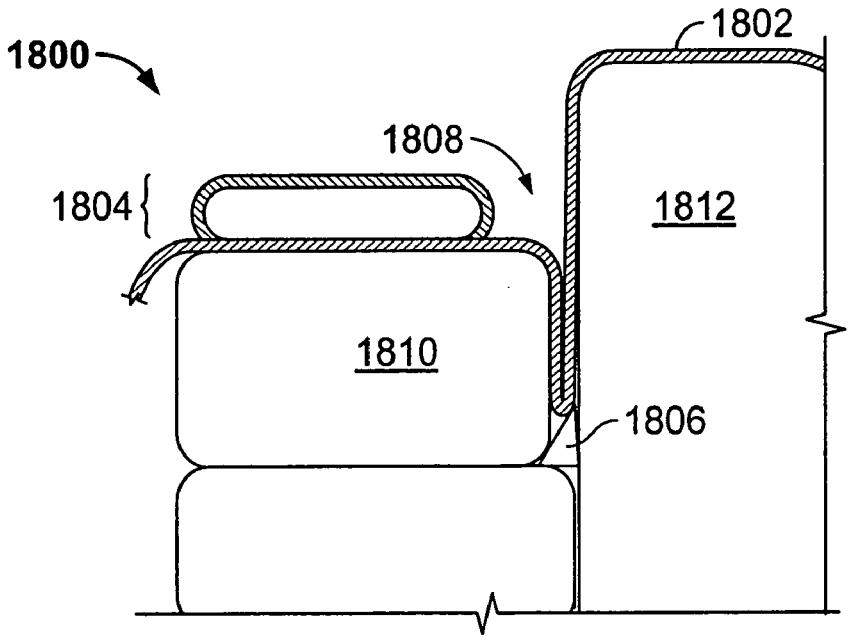
FIG. 18 is a diagram of one embodiment of an anchor that is secured to a non-end portion of a fabric sheet.

Referring now to FIG. 18, there is shown a slipcover 1800 that includes a fabric sheet 1802, a multi-layered component 1804, and an anchor 1806. A portion of the fabric sheet can be inserted into the crevice 1808 between the seating structure portion 1810 and the adjoining portion 1812. The anchor 1806 can also be inserted into the crevice 1808 and can be secured to the insertable portion of the fabric sheet 1802. The anchor 1806 is configured to resist force and movement in a direction exiting the crevice 1808 when it is lodged in the crevice. In this manner, because the anchor 1806 resists movement, the fabric sheet 1802 secured to the anchor also resists movement and can be held substantially in place by the anchor. The insertable portion of the fabric sheet 1802 can be a non-end portion of the fabric sheet, as illustrated, thereby allowing the fabric sheet to cover the cushion 1810 and the adjoining portion 1812 of the seating structure. However, the insertable portion of the fabric sheet can also be an end portion of the fabric sheet (not shown).

Figure 19:
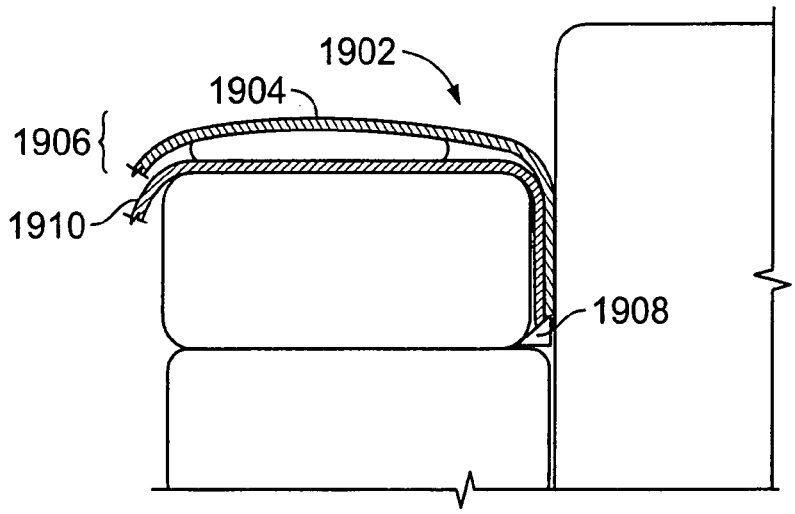
FIG. 19 is a diagram of one embodiment of an anchor that is secured to an extension that is a continuation of a top layer of fabric.
Figure 20:
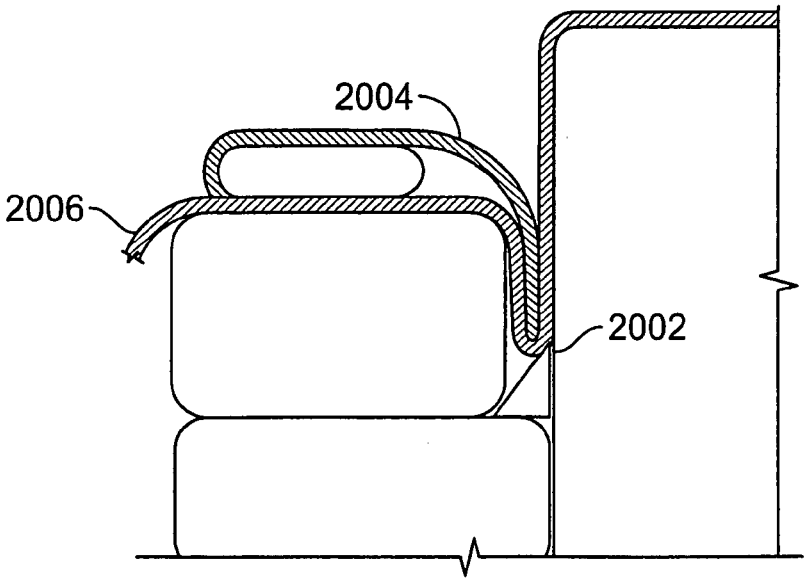
FIG. 20 is a diagram of one embodiment of an anchor that is secured to an end portion of an extension and to a non-end portion of a fabric sheet.
Figure 21:
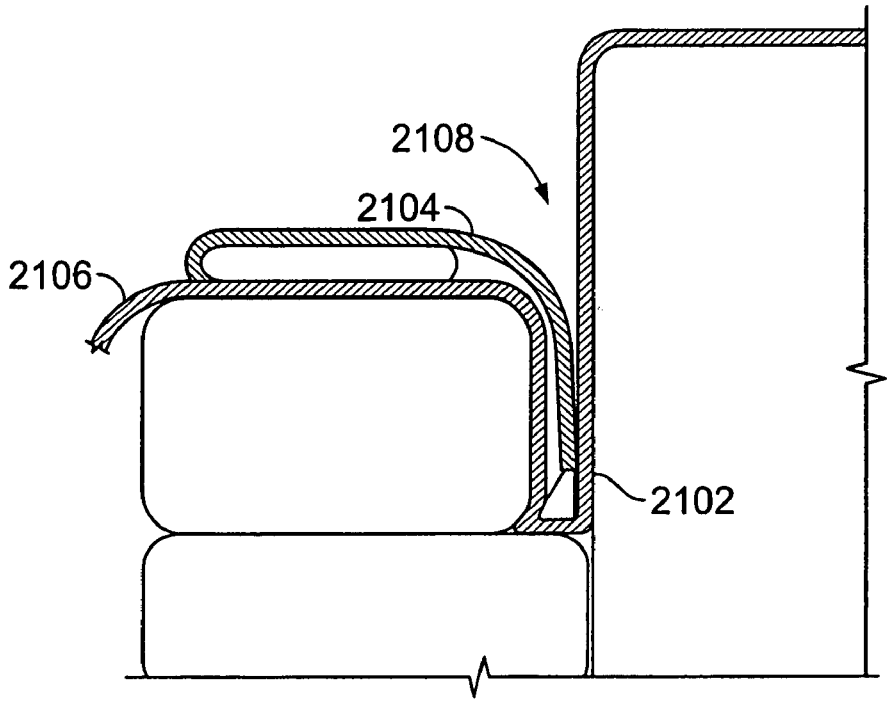
FIG. 21 is a diagram of one embodiment of an anchor that is secured only to an extension and that is surrounded by a portion of a fabric sheet.

FIGS. 19-21 show embodiments of a slipcover in which the anchor can be secured to an extension and/or to the fabric sheet. FIG. 19 shows an extension 1902 that is a continuation of the top layer of fabric 1904 of a multi-layered component 1906. An end portion of the extension 1902 is secured to the anchor 1908 along with an end portion of the fabric sheet 1910. However, the extension can also be distinct from the multi-layered component, as shown in FIGS. 20-21. FIG. 20 shows another embodiment in which the anchor 2002 is secured to an end portion of an extension 2004 and to a non-end portion of the fabric sheet 2006. FIG. 21 shows another embodiment in which the anchor 2102 is secured only to an extension 2104. However, a portion of the fabric sheet 2106 can be inserted into the crevice 2108 and positioned around the anchor 2102 so that the anchor still operates to keep the fabric sheet 2106 substantially in place.

An anchor according to the disclosed invention can be composed of one or more different materials. For example, the internal body of an anchor can include a compressible material such as polyester, cotton, batting, foam, soft fiber material, and/or other cushioning materials. An anchor can be composed entirely of flexible material or non-flexible material, or can be composed of combinations of flexible and non-flexible materials in various parts of the anchor. The outer surface of an anchor can include "non-slip" material that has a high degree of friction and/or is otherwise resistant to movement. Such materials can be, for example, rubber, polyester, and adhesive coatings. An anchor can also be enclosed completely or partially by the fabric sheet of a slipcover and/or the extensions of a multi-layered component, such as by being enclosed in a loop or pocket of the fabric sheet and/or extensions. An anchor can be secured to a fabric sheet and/or extensions of the top and/or bottom layer of a slipcover by fasteners and/or by sewing, quilting, tufting, and/or gluing. Fasteners can include decouplable devices such as zippers, buttons, snaps, ties, hooks, buckles, D-rings, clips, and a hook-and-loop type fastener, for example. Additionally, anchors of different shapes and sizes than those shown herein and/or that are composed of different materials than those described herein are contemplated and do not depart from the scope of the invention.

Another aspect of the invention includes a multi-layered component having one or more relaxation mechanisms therein. A relaxation mechanism is a small device that can perform various functions, including, for example, massage, heating, lumbar support, and/or audio functions.

One type of relaxation mechanism is a massage mechanism that is available in different varieties for performing different functions, such as kneading (also called Shiatsu), rolling, tapping, percussion, vibration, and/or air massage. Another relaxation mechanism is an adjustable lumbar support mechanism that can feature manual and/or electronic adjustment of the lumbar support. Still other relaxation mechanisms include heating mechanisms that produce warmth or audio mechanisms that produce music or nature sounds, such as the sound of waves. Examples of commercially available relaxation mechanisms include a four-way electronic massage and lumbar support mechanism such as that sold by the Schukra company of Toronto, Canada, and a battery-powered pulsating/vibration mechanism such as that sold under the trademark RELAXOR® by InSeat Solutions, LLC, of Santa Fe Springs, Calif.

Figure 22:
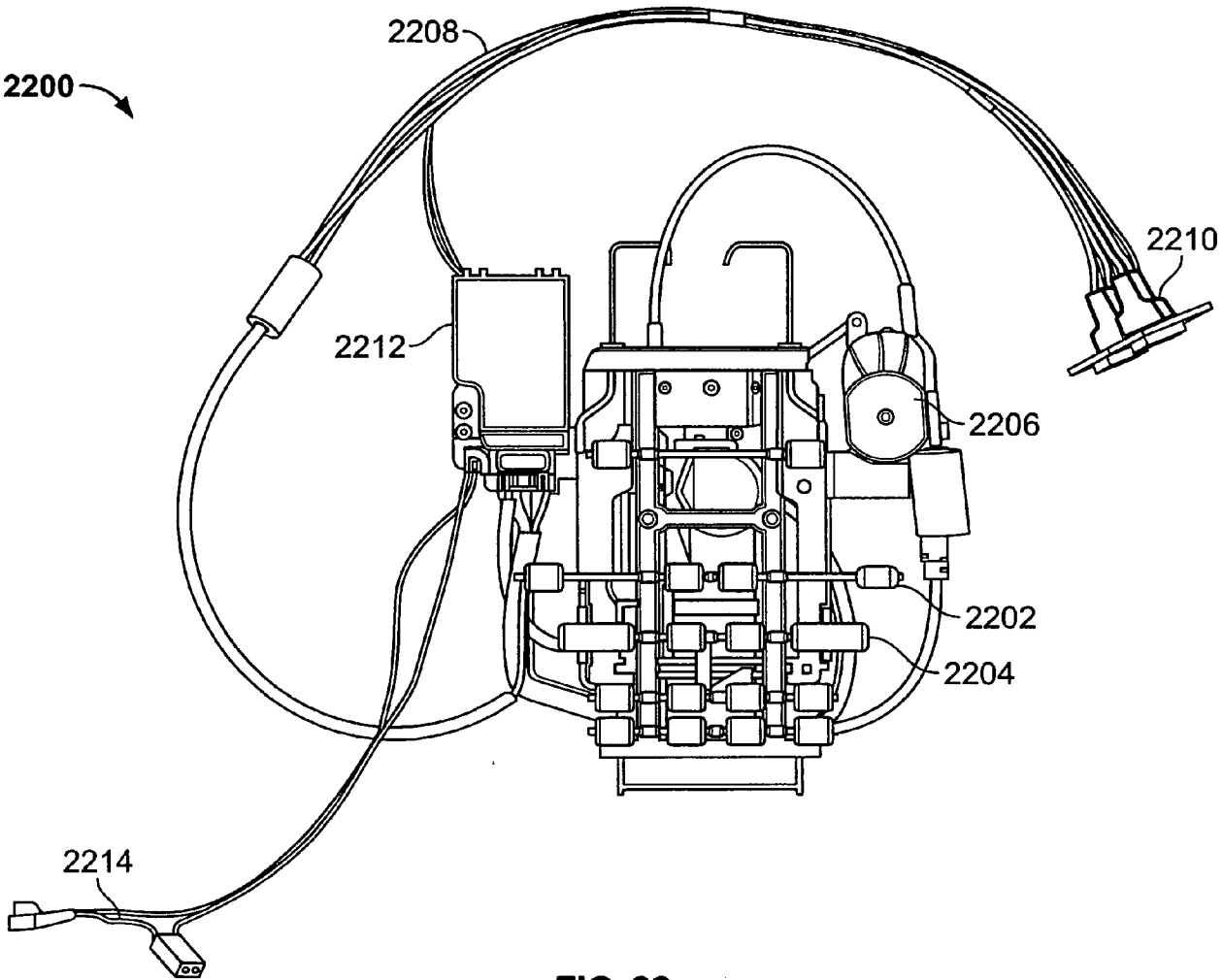
FIG. 22 is a diagram of one embodiment of a relaxation mechanism.

FIG. 22 shows a diagram of an exemplary relaxation mechanism. As shown in the illustration, the relaxation mechanism 2200 includes massage rollers 2202, a lumbar support mechanism 2204, motor components 2206, and control circuitry 2208. The motor components 2206 operate the massage rollers 2202 and the lumbar support mechanism 2204 and can have one mode of operation or multiple modes of operation. The control circuitry 2208 includes a user interface 2210 for turning on or off the relaxation mechanism and for selecting a mode of operation. The relaxation mechanism 2200 includes a power regulator 2212 and a power connection 2214 for delivering power to the motor components 2206. Alternatively, or in addition to the power connection, some relaxation mechanisms can also include compact, long life, rechargeable batteries (not shown). The weight of the relaxation mechanism 2200 can range from about one pound to seven pounds but can be another weight as well. The relaxation mechanism can occupy an area of about nine inches by eleven inches and a height of about one inch to three inches, although different dimensions are also available.

Figure 23:
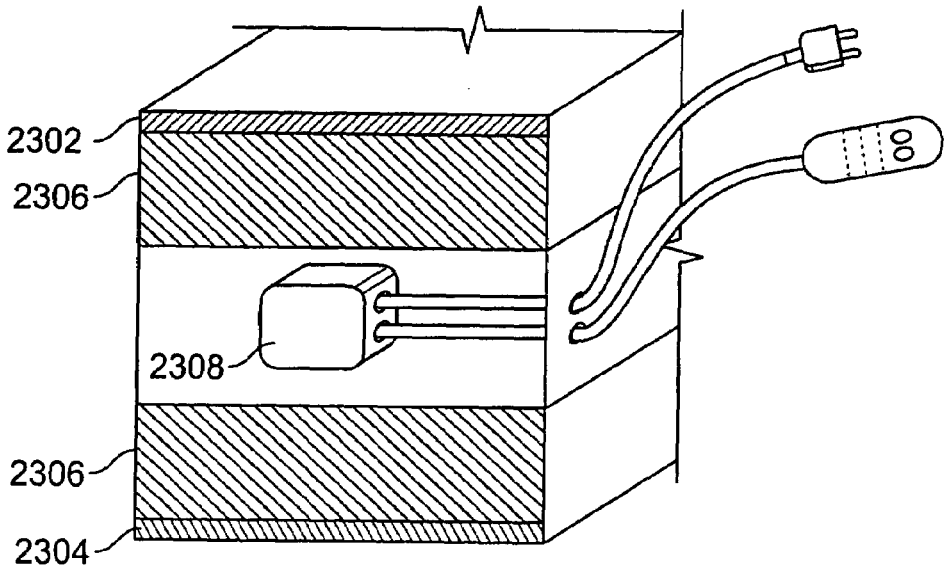
FIG. 23 is a diagram of one embodiment of a multi-layered component that includes relaxation mechanisms.

FIG. 23 shows a cross-sectional view of a multi-layered component that includes a layer of one or more relaxation mechanisms. The multi-layered component includes a top layer of fabric 2302, a bottom layer of fabric 2304, layer of cushioning materials 2306, and relaxation mechanisms 2308 embedded between the layer of cushioning materials 2306. The layers of cushioning materials 2306 can be partially composed of a firm cushioning substance, such as closed cell foam or another similar polymer, so as to allow the relaxation mechanism 2308 to be lodged in the cushioning material 2306. Optionally, the relaxation mechanism 2308 can also be secured to the layer of cushioning materials 2306 by fasteners and/or by sewing, quilting, tufting, gluing, and/or applying another adhesive or bonding agent (not shown).

Figure 24:
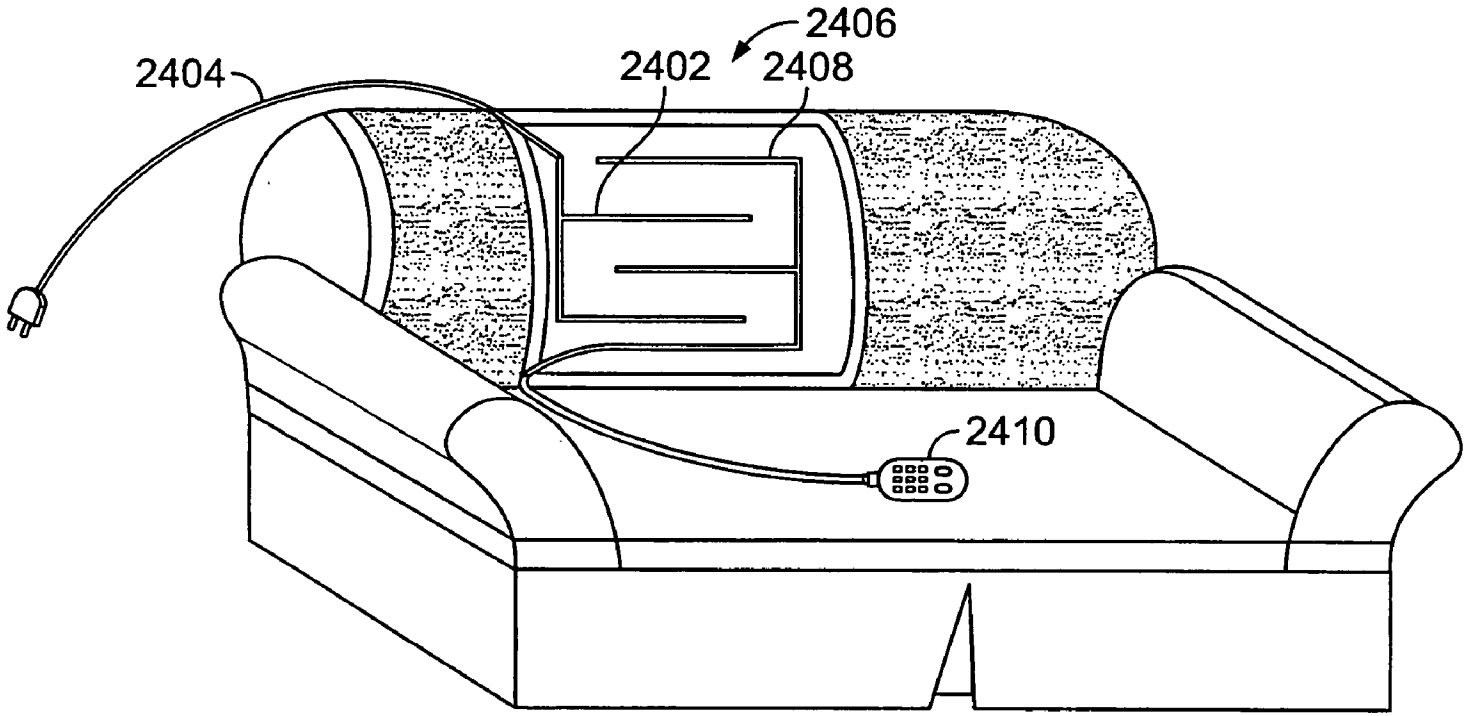
FIG. 24 is a diagram of one embodiment of a multi-layered component that includes relaxation mechanisms, a power connection, and a user interface.
Figure 25:
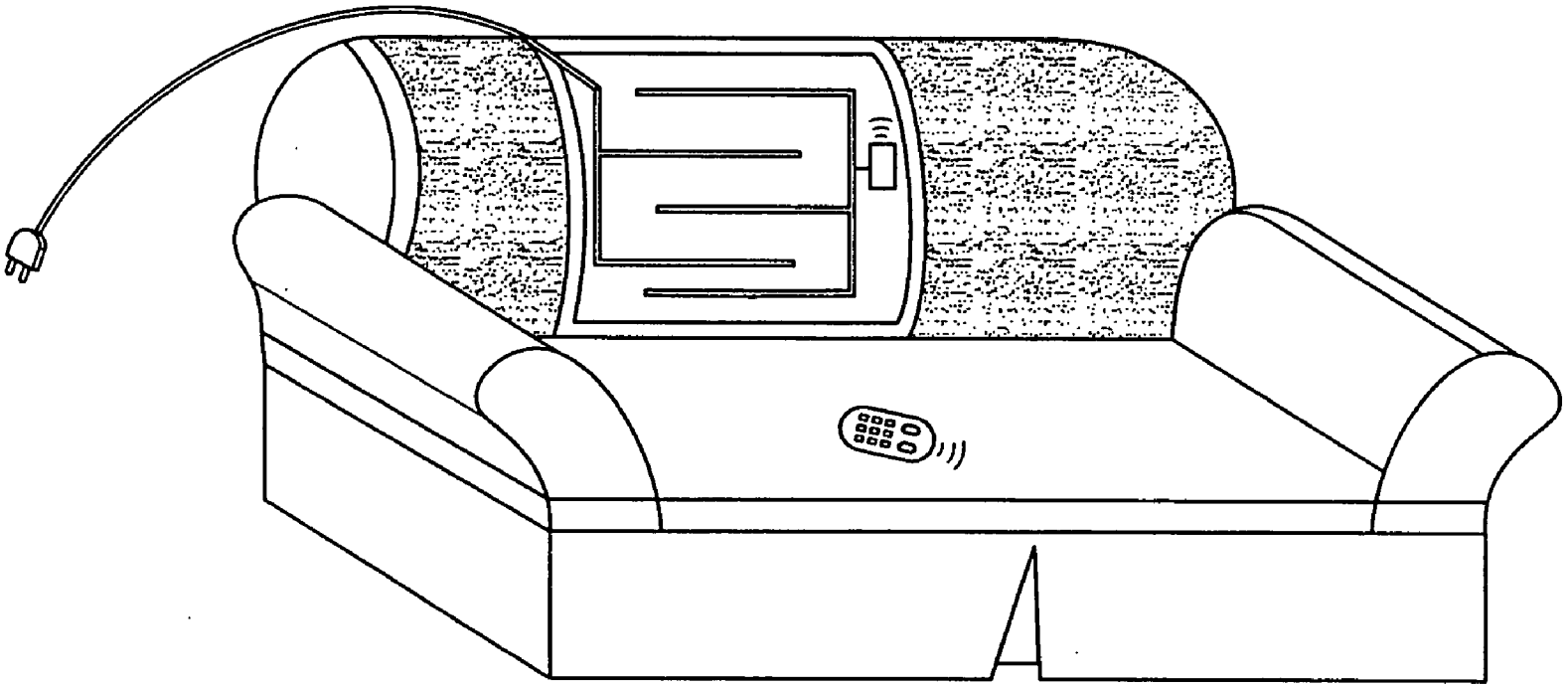
FIG. 25 is a variation of FIG. 24 in which the user interface is a wireless device.

In one embodiment, as shown in FIG. 24, a multi-layered component that includes relaxation mechanisms can have a grid of power and control connections. The grid of power connections 2402 can culminate in a central power connection 2404 exiting the multi-layered component 2406. The central power connection 2404 can be plugged into a power outlet to deliver power to the relaxation mechanisms (not shown) through the power connection grid 2402. It will be understood that the grid of power connections 2402 forms closed circuits with the relaxation mechanisms to power the relaxation mechanisms. The grid of control connections 2408 can connect to a user interface 2410 that is outside and/or on the surface of the multi-layered component 2406. The user interface 2410 can be secured to the surface of the multi-layered component 2406 by fasteners and/or bonding agents (not shown) and can be secured to a depth edge of the multi-layered component 2406. Alternatively, the user interface can be enabled for wireless communication and can communicate with a receiver that is attached to the grid of control connections, as shown in FIG. 25. When a user interacts with the user interface 2410, the user interface can communicate the control signals to the control connection grid 2408, which can then deliver them to the relaxation devices. As with the power connections, it will be understood that the grid of control connections 2408 forms closed circuits with the relaxation mechanism. The illustrated power connections and control connections are exemplary. Variations in the arrangement and configuration of power connections and control connections are contemplated and do not depart from the scope of the invention.

Figure 26:
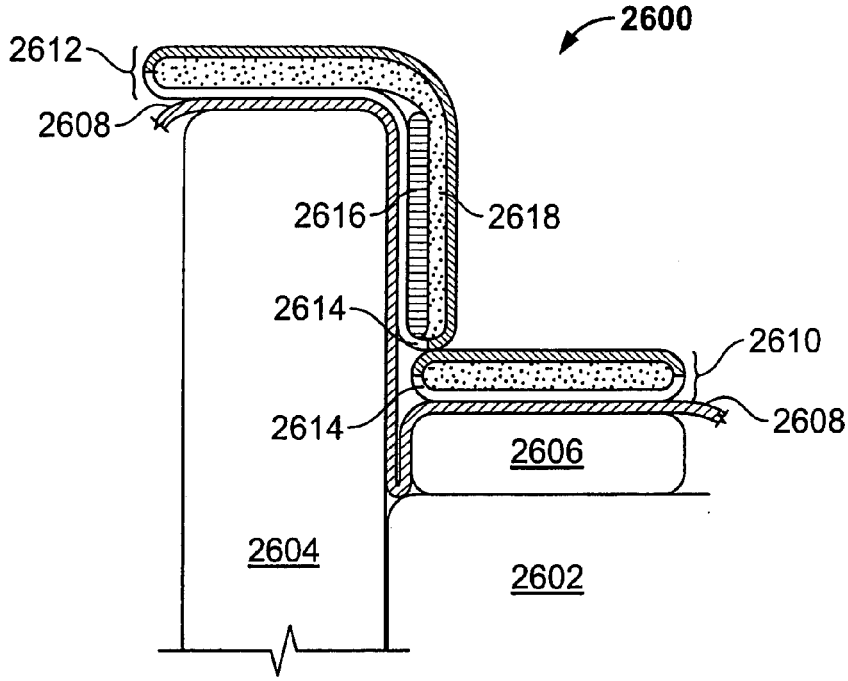
FIG. 26 is a diagram of one embodiment of a slipcover in which relaxation mechanisms are deployed in a back multi-layered component.

FIG. 26 shows a cross-sectional view of a slipcover that contains a layer of relaxation mechanisms. The slipcover 2600 is covering a seating structure that includes a seating portion 2602, a back portion 2604, and a seat cushion 2606. The slipcover includes a fabric sheet 2608, a seat multi-layered component 2610, and a back multi-layered component 2612. The multi-layered components each have a bottom layer of fabric 2614 that can be secured to the fabric sheet 2608 by fasteners (not shown) and/or by sewing, quilting, tufting, and/or applying an adhesive or bonding agent (not shown). The back multi-layered component 2612 includes a layer of relaxation mechanisms that can be embedded in cushioning material 2616 and also another layer of cushioning material 2618 that may improve comfort. The cushioning material 2618 can be a softer cushioning material, such as visco-elastic memory foam of different grades, qualities, densities, heights, and shapes, for example. The multi-layered components 2610,2612 can be configured so that layers of cushioning material and/or relaxation mechanisms can be inserted or removed from the multi-layered components, as shown and described in connection with FIG. 3 herein. The back multi-layered component 2612 can include a power connection grid and control connection grid as shown in FIGS. 24-25. The embodiment of FIG. 26 is exemplary and variations are contemplated. For example, the multi-layered components may not include a bottom layer of fabric. Rather, the top sheet of fabric can be secured to the fabric sheet by fasteners, by sewing, quilting, tufting, and/or applying an adhesive or bonding agent, or by extensions as shown and described in connection with FIG. 5.

Figure 27:
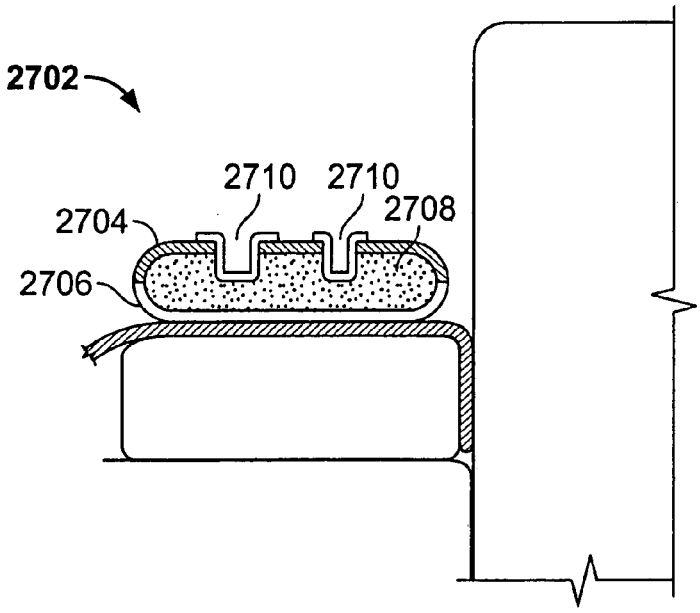
FIG. 27 is a diagram of one embodiment of a multi-layered component that includes embedded holders.

In another aspect of the invention, a slipcover can include a multi-layered component that includes holders embedded onto the surface thereof. Holders can be, for example, a cup holder, a remote control holder, or another holder for holding other objects. Referring to FIG. 27, a multi-layered component 2702 can include a top layer of fabric 2704, a bottom layer of fabric 2706, a layer of cushioning material 2708, and holders 2710 embedded into the cushioning material 2708. The cushioning material 2708 can be composed of a material that can secure the holders 2710 in place, such as closed cell foam. Typically, a holder is embedded into the layer of cushioning material at the time the multi-layered component is manufactured. In one embodiment, only holders that leave at least one-half inch of non-depressed cushioning material are used.

A cup holder can be about 1½ inches to four inches in depth and can have an inner diameter of about 2¾ inches to 3½ inches. The cup holder can have a flange around its opening that is about ¼ inch to ½ inch in size. There can be a liner material inside the holder space made of metal, plastic, or a polymer, and can include materials that insulate heat and/or coldness. A remote control holder can include a vertical space for holding a remote control vertically. The opening can be about 4 inches by 6 inches in size. As with the cup holder, the liner of the remote control holder can be composed of metal, plastic, or a polymer, and can include materials for insulating heat or coldness. A remote control holder can also have a flanged edge around the opening that can be about ¼ inch-½ inch in size. Remote controls can range in size from about two inches to four inches in width, with about 2.75 inches being average, from about five inches to ten inches in length, with about eight inches being average, and from about one to two inches in thickness, with about 1.25 inches being average. In order to accommodate the smallest remote controls, the depth of the holder should be at least three inches to be able to vertically hold a remote control.

Figure 28:
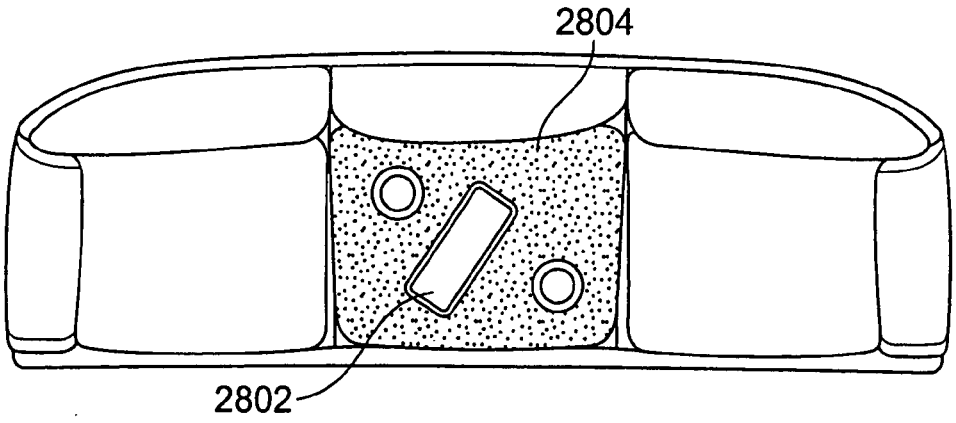
FIG. 28 is a diagram of a top-down view of one embodiment of a multi-layered component in accordance with FIG. 27.

FIG. 28 shows a top-down view of one arrangement of cup holders and a remote control holder that are embedded into a multi-layered component. The remote control holder 2802 can hold at least two remote controls horizontally. The remote control holder 2802 is about eight inches wide, twelve inches long, and two inches deep. Although only one multi-layered component 2804 is shown in FIG. 28, the slipcover can also include other multi-layered components and other aspects of the disclosed invention that are not shown.

Figure 29:
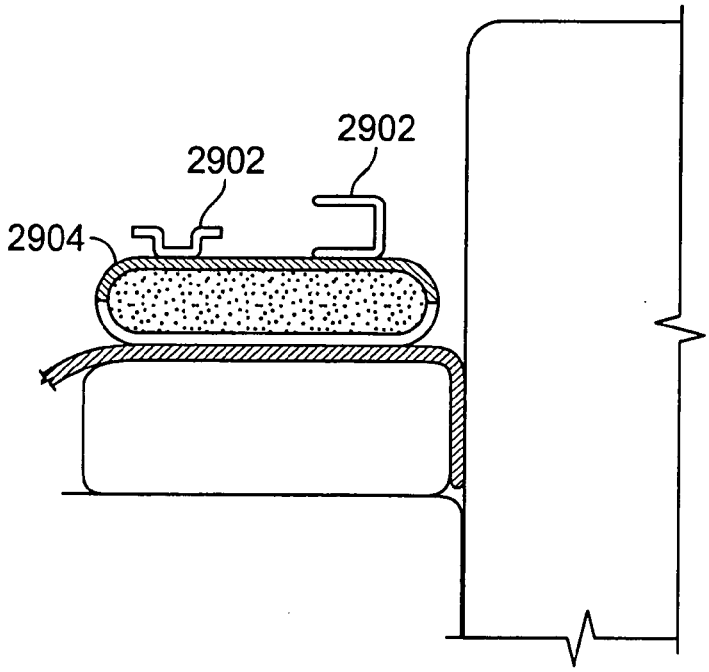
FIG. 29 is a diagram of one embodiment of a multi-layered component that includes holders secured to the surface thereof.
Figure 30:
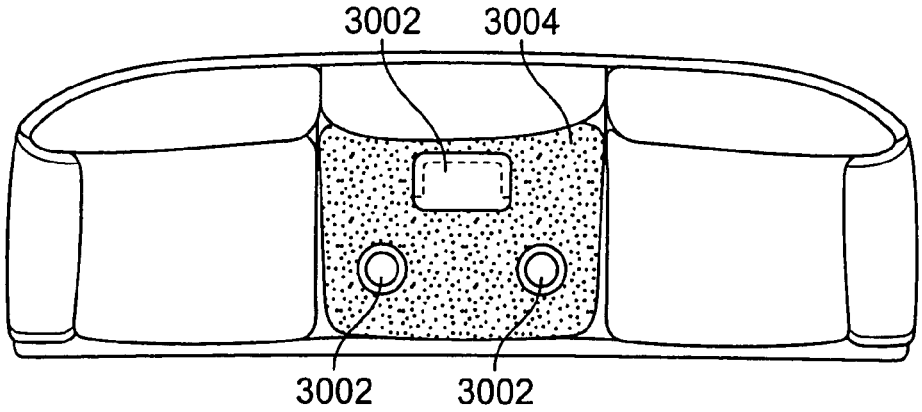
FIG. 30 is a diagram of a top-down view of an embodiment of a multi-layered component in accordance with FIG. 29.

FIG. 29 shows another embodiment-of a holder in which the holders are secured to the surface of a multi-layered component. The holders 2902 can be secured to the top layer of fabric 2904 by an adhesive or bonding agent and/or by fasteners, sewing, quilting, and/or tufting (not shown). FIG. 30 is a top-down view of an arrangement of cup holders and a remote control holder in accordance with FIG. 29, in which the holders 3002 are secured to the surface of the multi-layered component 3004. Although only one multi-layered component 3004 is shown in FIG. 30, the slipcover can also include other multi-layered components and other aspects of the disclosed invention that are not shown.

Figure 31:
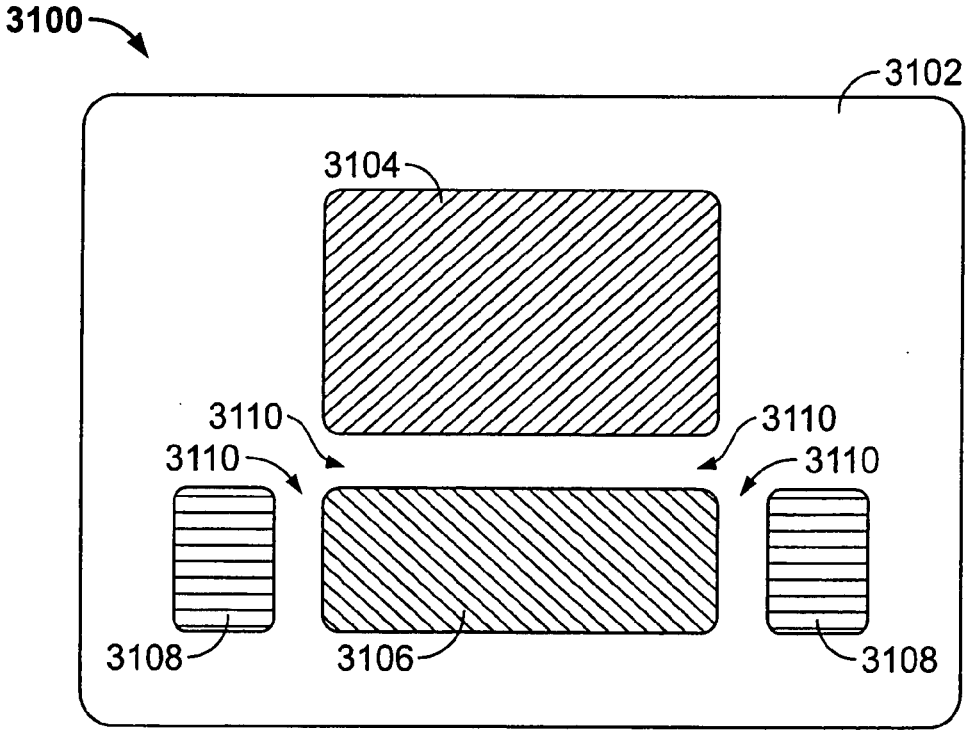
FIG. 31 is a diagram of a slipcover in which a fabric sheet has multi-layered component regions and fabric sheet portions between the multi-layered component regions.

In another aspect of the invention, a slipcover may be used to cover a variety of seating structures. In order to accommodate these different types and sizes of seating structures, the slipcover can include multi-layered components that can be replaced and/or customized depending on the needs of the seating structure and the needs of its user. Referring now to FIG. 31, there is shown a slipcover 3100 that includes a fabric sheet 3102 that has corresponding portions to which multi-layered components can be secured. For example, the portions include a back portion 3104, a seat portion 3106, and two arm portions 3108. The portions may also include skirt and/or foot rest portions (not shown). While FIG. 31 illustrates a fabric sheet where the multi-layered components are secured to the top of the fabric sheet, the multi-layered components can also be secured in part or in whole to any edges of the fabric sheet or secured from below the fabric sheet, as previously described herein in connection with FIG. 3. One or more multi-layered components can be secured to the fabric sheet portions by decouplable fasteners on the fabric sheet (not shown). They also can be secured by sewing, quilting, tufting, applying adhesives and/or bonding agents, or by friction or interaction with a friction enhancing material. As shown in the illustration, the fabric sheet portions are separated so as to have fabric sheet portions 3110 between them. These fabric sheet portions 3110 allow the multi-layered components to rest upon other multi-layered components. Additionally, if the seating structure has a crevice, the fabric sheet portion 3110 can also be inserted into the crevice. These features become clearer when described below in conjunction with FIGS. 32-35.

Figure 32:
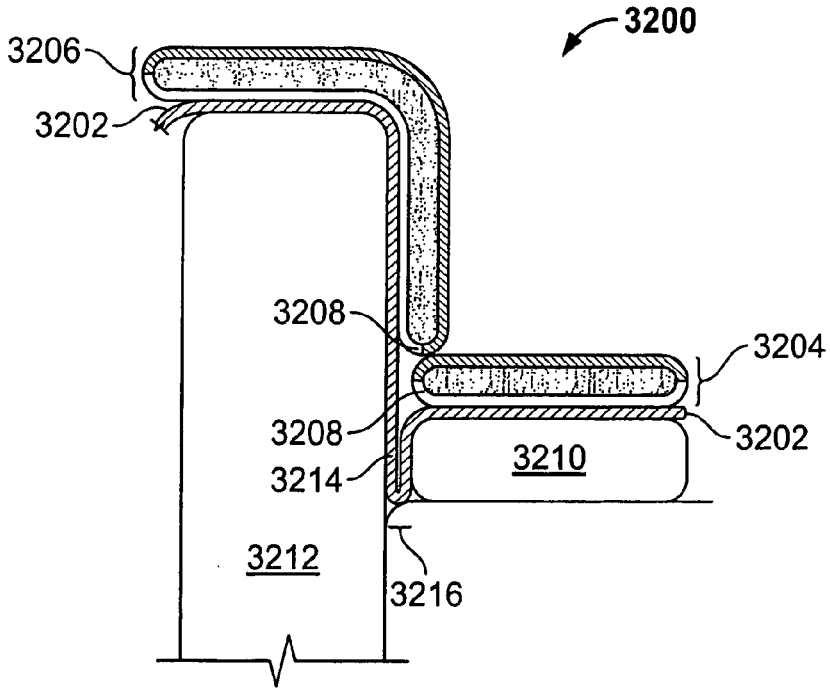
FIG. 32 is a diagram of one embodiment of a slipcover in which the back multi-layered component rests upon the seat multi-layered component.
Figure 33:
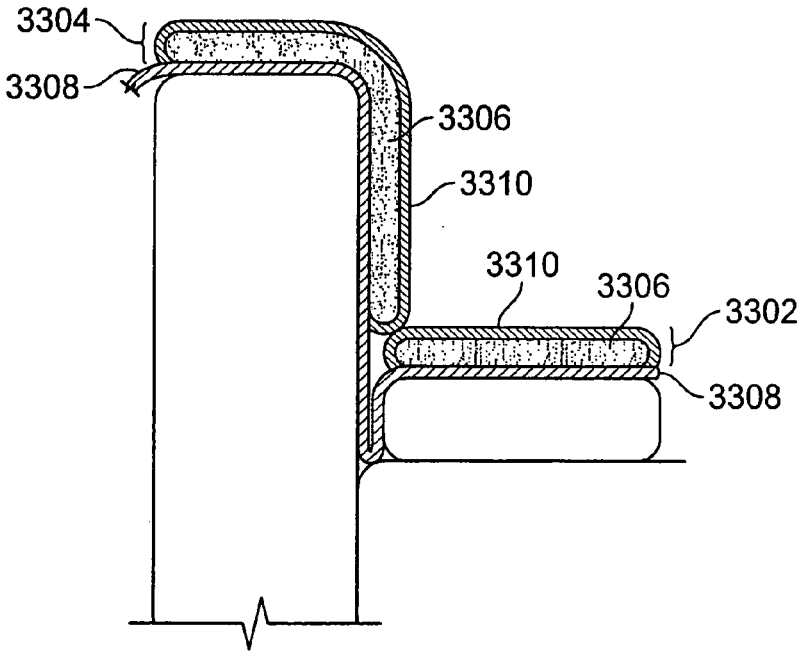
FIG. 33 is a variation of FIG. 32 in which the multi-layered components do not have bottom layers of fabric.

FIG. 32 shows a side, cross-sectional view of a slipcover 3200 that includes a fabric sheet 3202, a seat multi-layered component 3204, and a back multi-layered component 3206. The bottom layer of fabric 3208 of the multi-layered components can be removably secured to the fabric sheet 3202 using decouplable fasteners (not shown). The slipcover 3200 is covering a seat cushion 3210 and a back portion 3212 of a seating structure. As shown in the illustration, the multi-layered components 3204,3206 are secured to the fabric sheet 3202 so as to have a fabric sheet portion 3214 between them. This fabric portion 3214 allows the back multi-layered component 3206 to rest upon the seat multi-layered component 3204. Additionally, the fabric sheet portion 3214 can also be inserted into the crevice between the seat cushion 3210 and the back portion 3212 of the seating structure. Based on friction and pressure within the crevice 3216, the inserted fabric sheet portion 3214 can maintain the slipcover 3200 substantially in place. The fabric sheet portion 3214 that is inserted into the crevice 3216 can also secured to anchors, as shown in FIGS. 15-17, for example. FIG. 33 shows a variation of the slipcover of FIG. 32 in which the multi-layered components 3302,3304 do not have a bottom layer of fabric. In this case, the layer of cushioning material 3306 can be secured to the fabric sheet 3308, or the top layer of fabric 3310 can be secured to the fabric sheet 3308 at the perimeter of the multi-layered components. Alternatively, the multi-layered components 3302,3304 can be secured to the fabric sheet 3308 by extensions as described in connection with FIG. 5.

Figure 34:
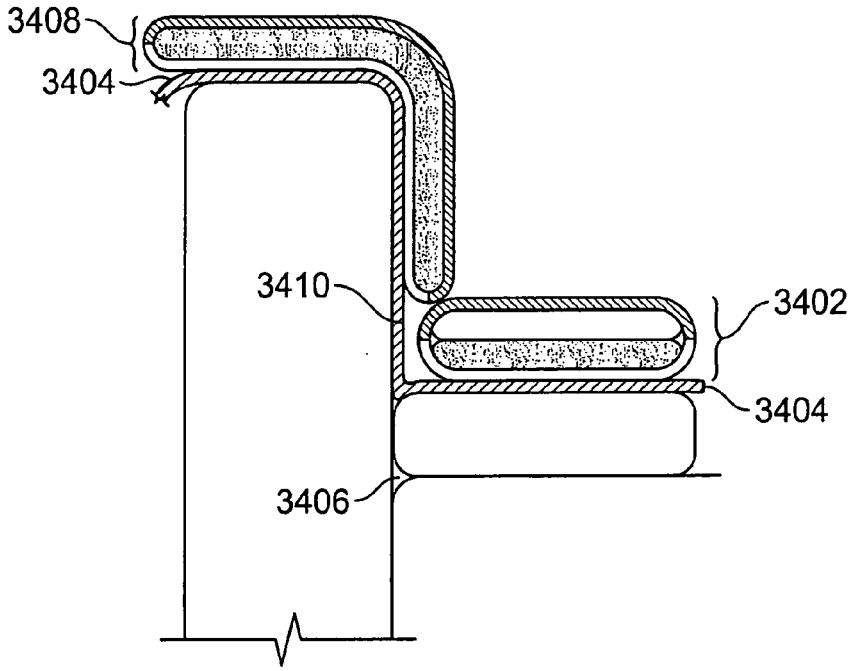
FIG. 34 is a diagram of an embodiment of a slipcover in which the back multi-layered component rests upon a thicker seat multi-layered component.

Referring to FIG. 34, a user may wish to replace or customize the multi-layered components and/or the layers therein. For example, a user may wish to replace a multi-layered component with one that includes relaxation mechanisms, as described in connection with FIG. 26, which can be relatively thicker. Furthermore, a user may decide to insert additional layer of cushioning materials into the multi-layered component for comfort. Alternatively, a user may remove the layer of cushioning material and replace it with a thicker layer of cushioning material. Therefore, the resulting multi-layered component may be much thicker. One example of a thicker seat multi-layered component is shown in FIG. 34, wherein the fabric sheet and the seating structure are the same as those in FIG. 32. Because the seat multi-layered component 3402 is much thicker, most of the fabric sheet 3404 portion is pulled out of the crevice 3406 to allow the back multi-layered component 3408 to rest upon the seat multi-layered component 3402. In the illustration, little to no fabric sheet portion 3410 remains in the crevice 3406. However, as previously described herein, the fabric sheet portion 3410 can be secured to anchors lodged within the crevice (not shown).

Figure 35:
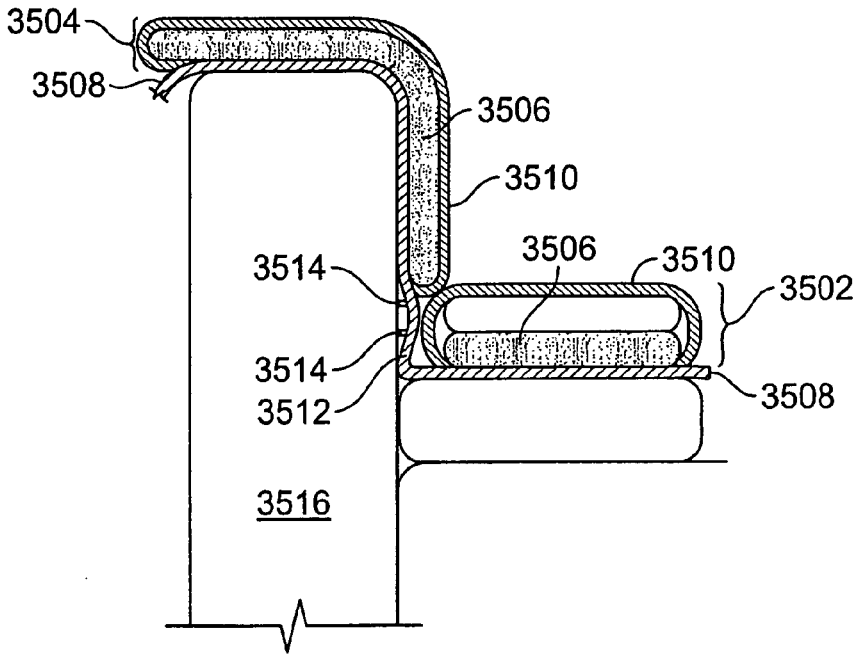
FIG. 35 is a variation of FIG. 34 in which the multi-layered components do not have bottom layers of fabric and in which the fabric sheet includes fasteners.

FIG. 35 shows a variation of the slipcover of FIG. 34, in which the multi-layered components 3502,3504 do not have a bottom layer of fabric. In this case, the layer of cushioning material 3506 can be secured to the fabric sheet 3508, or the top layer of fabric 3510 can be secured to the fabric sheet 3508 at the perimeter of the multi-layered components. Alternatively, the multi-layered components 3502,3504 can be secured to the fabric sheet 3508 by extensions as described in connection with FIG. 5. Additionally, the fabric sheet portion 3512 and/or fabric sheet portion 3508 can include fasteners 3514 that can fasten to parts of the seating structure 3516. For example, the fasteners 3514 can be ties that can be tied around the frame of the seating structure 3516. The fasteners 3514 can also be zippers, snaps, buttons, hooks, D-rings, straps, or hook-and-loop type fasteners.

Although FIGS. 32-25 show a back multi-layered component resting upon a seat multi-layered component, it will be understood that this aspect of the invention applies to arm multi-layered components and other multi-layered components as well. For example, a slipcover can include a fabric sheet portion between an arm multi-layered component and a seat multi-layered component so as to allow the arm multi-layered component to rest upon the seat multi-layered component. Also, it will be understood that the slipcover of FIGS. 32-25 can be used in connection with various types and arrangements of seating structures other than that shown.

Figure 36:
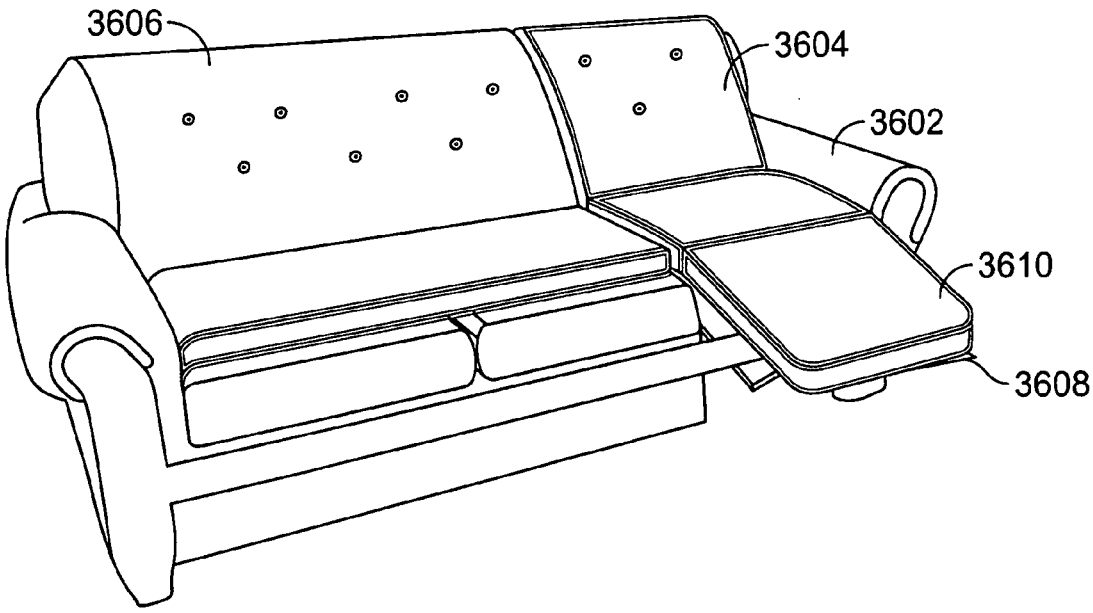
FIG. 36 is a diagram of one embodiment of a seating structure that is covered by a combination of slipcovers that each cover a portion of the seating structure.
Figure 37:
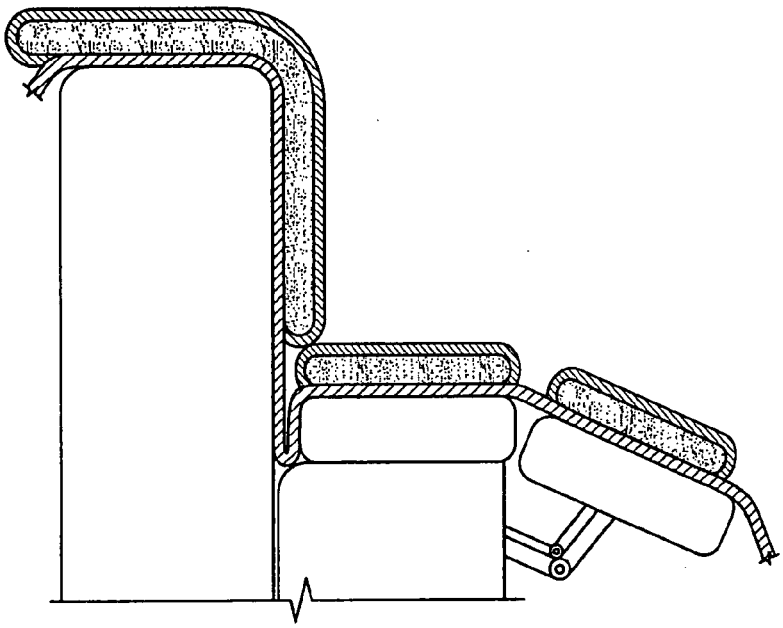
FIG. 37 is a diagram of one embodiment of a slipcover for covering a seating structure that has a recliner feature.

In another aspect of the invention, a slipcover can be configured to cover less than the entirety of a seating structure. FIG. 36 shows a sofa 3602 that can accommodate multiple users. The sofa includes two slipcovers, where one slipcover 3604 is covering one portion of the sofa and where the other slipcover 3606 is covering another portion of the sofa. The illustrated sofa includes a recliner feature 3608 in a part of the sofa. This recliner portion of the sofa is covered by the slipcover 3604 that includes a multi-layered component 3610 on a foot rest portion 3608 of the sofa, as shown in FIG. 37. When the recliner 3608 is retracted, the slipcover folds at the fabric sheet portion and the foot rest multi-layered component can lay in front of the seating structure. The illustrated slipcovers 3604,3606 in FIG. 36 each include a back multi-layered component and a seat multi-layered component. The multi-layered components can be secured to the fabric sheet of the slipcover by fasteners and/or by sewing, quilting, tufting, gluing, and/or applying an adhesive or bonding agent. The slipcovers can also include previously described aspects of the invention, including extensions, anchors, relaxation mechanisms, and/or holders. Combinations of slipcovers having a variety of multi-layered components can be arranged on a single seating structure to provide customization to meet a user's needs.

Figure 39:
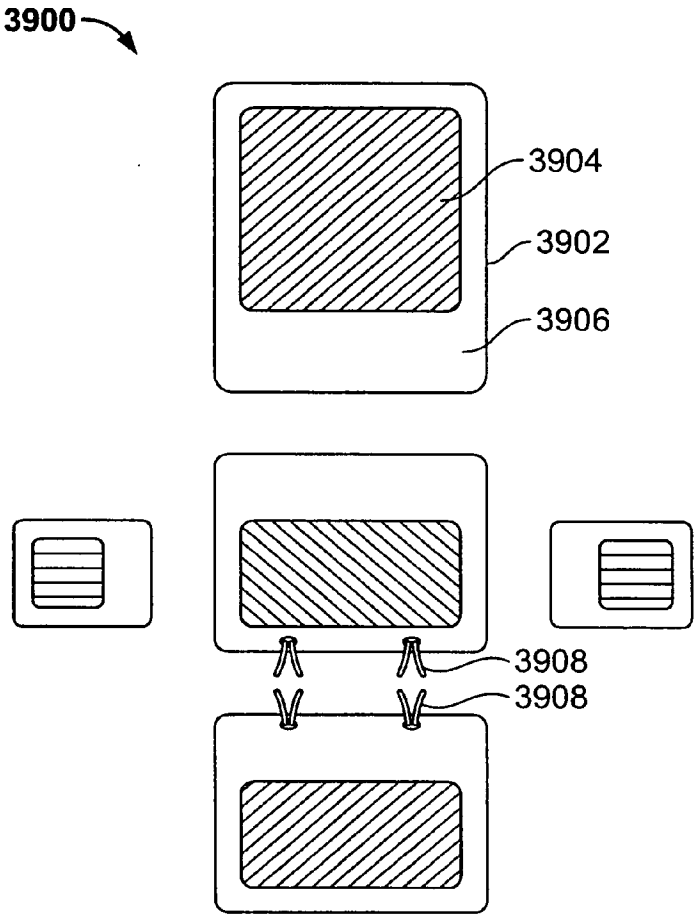
FIG. 39 is a diagram of a slipcover that includes several distinct units.
Figure 38:
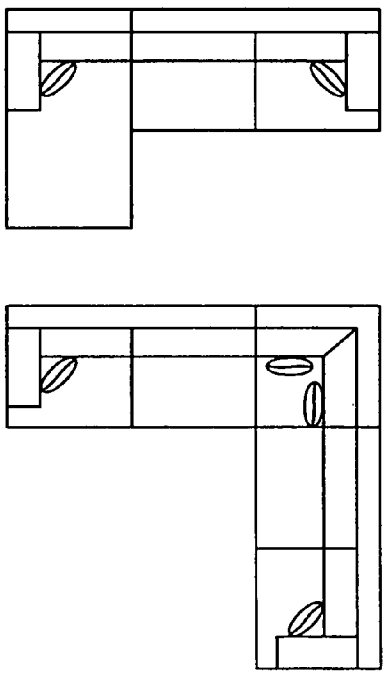
FIG. 38 is a diagram of various arrangements of seating structures that can be formed using modular seating structures.

FIG. 38 shows top-down views of various seating structure arrangements that may require use of more than one slipcover. For example, seating structures can be formed using modular components that include an armless chair, an armless loveseat, loveseats with one arm, a corner seating unit, and a chaise with one arm, among others. FIG. 39 shows a slipcover 3900 that can include separate units corresponding to different seating structure portions. The units can be attached to each other to accommodate various types of seating structures including multi-user seating such as sectionals. The units can correspond to a back portion, a seat portion, arm portions, a skirt portion, and/or a foot rest portion of a seating structure. Each unit includes a fabric sheet 3902 that has a portion 3904 to which one or more multi-layered components can be attached. The fabric sheets 3902 also include portions 3906 that do not correspond to multi-layered components and that can be inserted into crevices. Fabric sheet 3902 and fabric sheet portion 3904 can be attached to fabric sheet portions on other units of the slipcover 3900 by fasteners 3908 and/or by sewing, quilting, tufting, and/or applying a bonding agent (not shown). The fasteners can be decouplable fasteners such as a zipper, a button and a button hole, a snap, a tie, a hook, a buckle, a D-ring, a clip, and/or hook-and-loop fasteners.

Accordingly, what has been described thus far are slipcovers for covering a variety of seating structures. The slipcovers can include a fabric sheet, multi-layered components, extensions, anchors, relaxation mechanisms, and/or holders, and can be configured to cover all or a portion of a seating structure. The multi-layered components can be removably secured to the fabric sheet by decouplable fasteners, or can be non-removably secured to the fabric sheet by sewing, quilting, tufting, gluing, and/or applying an adhesive or bonding agent. The internal layers of a multi-layered component can also be removable, or a multi-layered component can be configured to allow additional layers to be inserted.

The fabric sheet can be one or more portions. The portions may be the same or different materials. The portions may be adjacent or non-adjacent. The fabric sheet and/or the top and bottom layers of fabric of a multi-layered component can be made from aesthetic materials that include real leather, faux leather, vinyl, various hides, exotic hides (such as sharkskin, lizard, alligator and ostrich), real fur, and faux fur, for example. The slipcover, or portions thereof, can also include water-resistant or water-proof materials, or can be treated to be water-resistant or water-proof. Examples of water-resistant or water-proof fabric materials include rubber, vinyl, polyurethane, PVC, polypropylene, nylon, Goretex, acrylic, latex, PET, silicone, teflon, taslan, polyethylene, or another material that is water-resistant or water-proof. In place of, or in addition to, the having such materials, a slipcover can be chemically treated (e.g., sprayed or coated) with a water-resistant or water-proofing agent such as wax-based silicone. The slipcover, or portions thereof, can also be made from materials that resist movement, such as rubber, vinyl, polyester scrim coated with PVC, polyurethane, nylons, latex, PET, silicone elastomers, or another material that has an high degree of friction. Alternatively, or in addition to having such materials, a slipcover can be chemically treated using a material having a high degree of friction. In addition, materials that are resistant to ultraviolet radiation can be included, such as dyed acrylic and polyvinylchloride (PVC) textiles. In addition, materials that are called "performance fabrics" can be included, such as ballistic nylon and fabrics treated with branded chemicals like "Scotchgard" or unbranded chemicals with similar effects that provide performance and protection. It will be understood that the materials described herein can form various portions of a slipcover and can be in, on, or part of various portions of a slipcover.

A slipcover according to the aspects of the disclosed invention can be used to cover a variety of seating structures, as shown in FIGS. 40-46.

Figure 40:
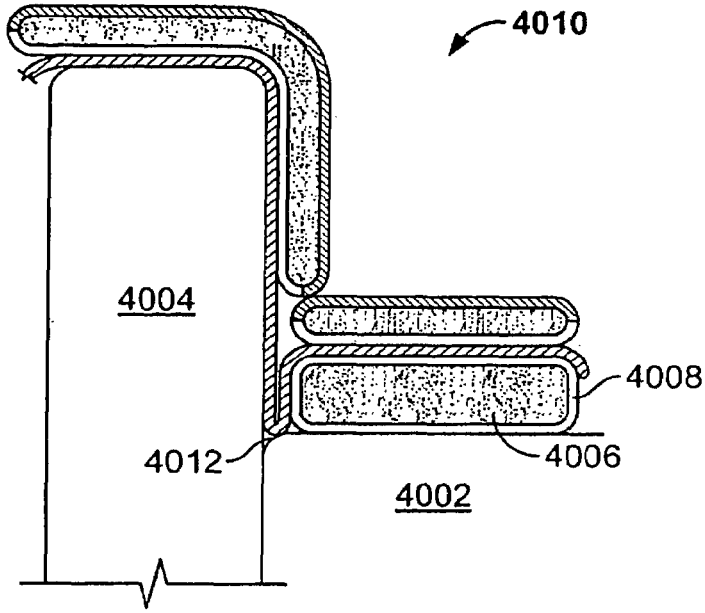
FIG. 40 is a diagram of one embodiment of a slipcover for covering a seating structure that is already covered by another slipcover.

FIG. 40 shows a seating structure that is already covered by an existing slipcover. In particular, the seating structure includes a seating structure portion 4002, an adjoining portion 4004, and a cushion 4006, where the cushion 4006 is already covered by a fitted slipcover 4008. A slipcover 4010 according to the disclosed technology can be used to cover the seating structure over the existing slipcover 4008. If both slipcovers have fasteners (not shown), then they can be secured to each other by coupling the fasteners. Additionally, the top slipcover 4010 can also be tucked into crevices 4012 in the seating structure. Although this embodiment shows slipcover 4010 applied over a fitted slipcover 4008, slipcover 4010 can also be applied over semi-fitted and/or unfitted slipcovers.

Figure 41:
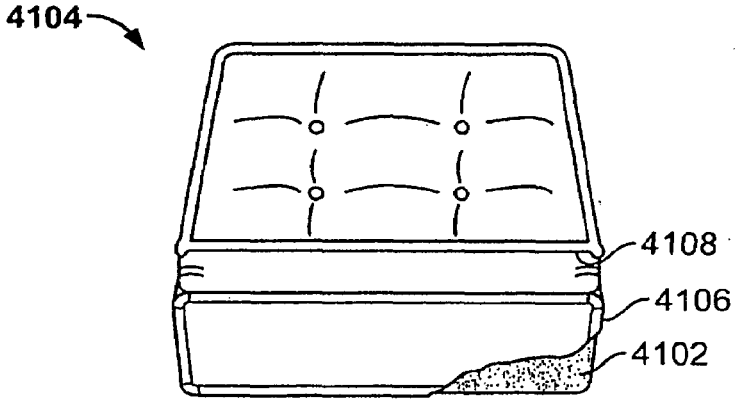
FIG. 41 is a diagram of one embodiment of a slipcover for covering a cushion or pillow.
Figure 42:
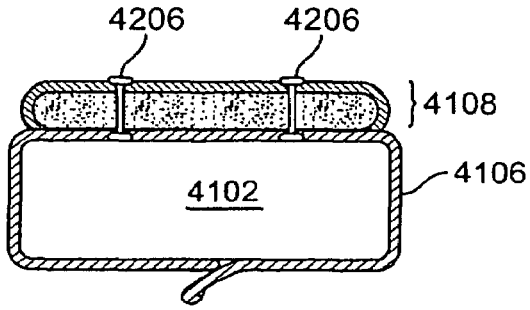
FIG. 42 is a cross-sectional view of FIG. 41.

FIG. 41 shows seating structure that is a cushion or pillow. The cushion 4102 can be a stand-alone unit or part of another seating structure. A pillow is not necessarily a sleeping pillow and can include floor pillows, pillows for back, neck, or lumbar support, or another pillow used for another purpose. The slipcover 4104 can be a fitted, semi-fitted, or unfitted slipcover, and includes a fabric sheet 4106 and a multi-layered component 4108 secured to the fabric sheet. In one embodiment, if the cushion or pillow has fasteners or if the slipcover has fasteners (not shown), the fabric sheet 4106-can be removably secured to the cushion or pillow 4102 using the fasteners. In one embodiment, the slipcover can be non-removably secured to the cushion or pillow 4102 by sewing, quilting, tufting, gluing, and/or applying an adhesive or bonding agent. FIG. 42 shows a cross-sectional view of the slipcover and cushion/pillow of FIG. 41. In the illustration, the multi-layered component 4108 is irremovably secured to the fabric sheet 4106 by tufting 4206. Alternatively, the multi-layered component 4108 can be secured to the fabric sheet by fasteners (not shown) and/or by sewing, quilting, and/or applying an adhesive or bonding agent (not shown). The fabric sheet 4106 can be secured to the cushion/pillow 4102 by being securely wrapped around the cushion/pillow. Additionally, the fabric sheet 4106 can be secured to the cushion/pillow 4102 by fasteners (not shown) and/or by sewing, quilting, tufting, and/or applying an adhesive or bonding agent (not shown).

Figure 43:
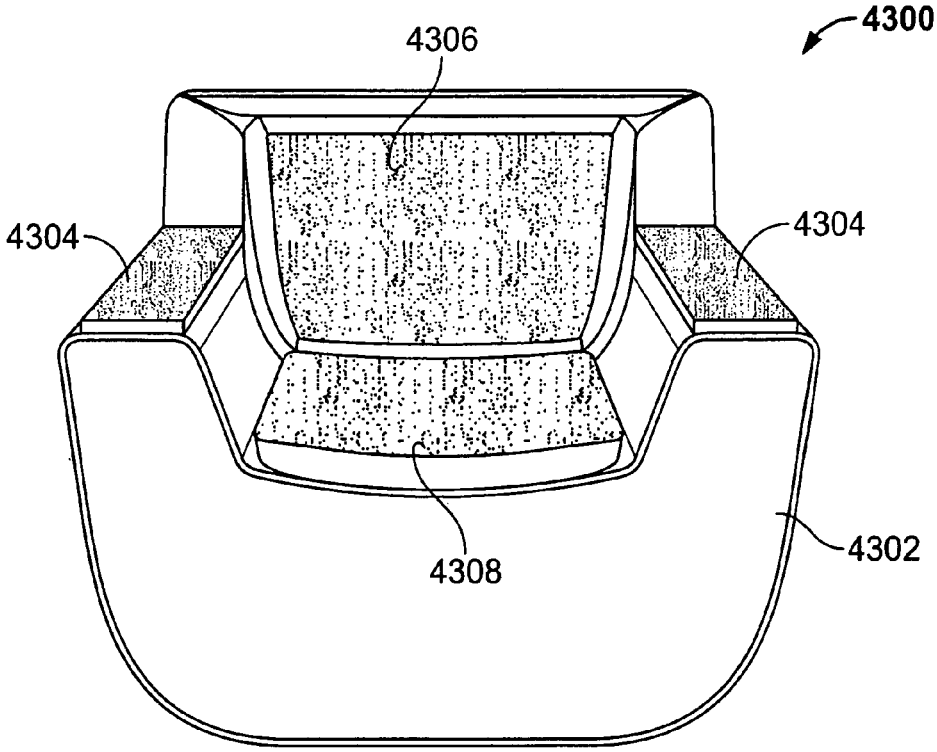
FIG. 43 is a diagram of one embodiment of a slipcover for covering frameless, soft furniture.
Figure 44:
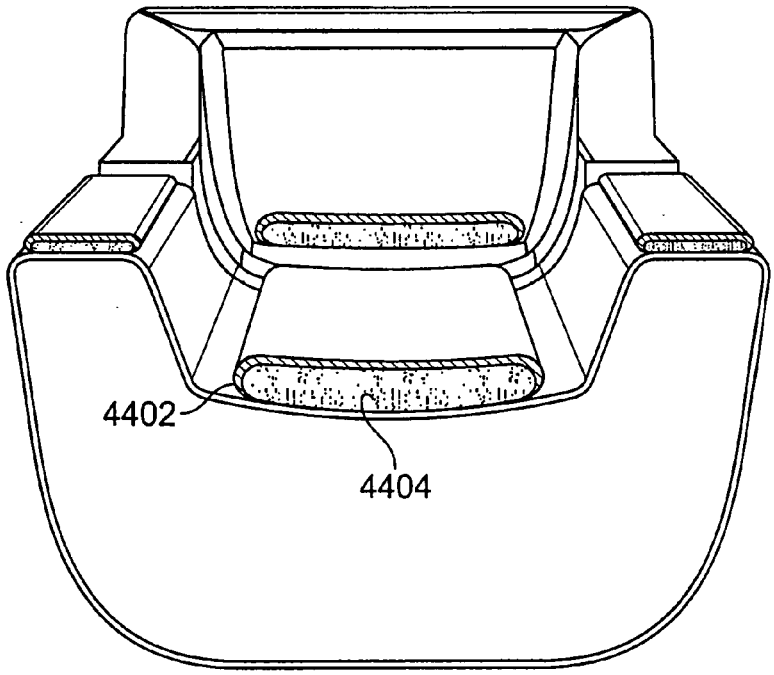
FIG. 44 is a cross-sectional view of FIG. 44.

FIG. 43 shows an embodiment of a slipcover that covers a seating structure that is frameless and substantially soft. The slipcover 4300 can include a fabric sheet 4302 and multi-layered components secured to the fabric sheet. The multi-layered components can correspond to an arm portion 4304, a back portion 4306, a seat portion 4308, and/or a foot rest portion (not shown) of the soft furniture. In one embodiment, soft, frameless furniture can be held in a soft-furniture holder that elevates the soft furniture above floor level (not shown). The holder can be made of wood, metal, vinyl, resin, or a polymer. A slipcover according to the disclosed technology can also be used to cover soft furniture that is placed on a soft-furniture holder. FIG. 44 shows an angled, cross-sectional view of the slipcover of FIG. 43. Each of the multi-layered components include a top layer of fabric 4402 and a layer of cushioning material 4404.

Figure 45:
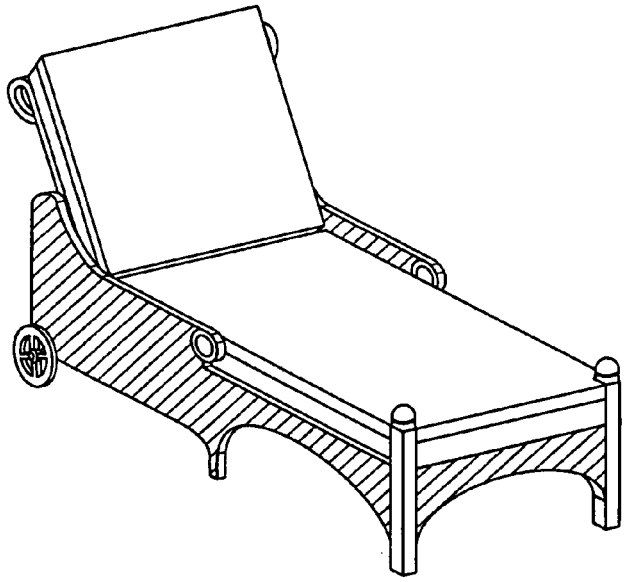
FIG. 45 is a diagram of one embodiment of a slipcover for covering an outdoor recliner seating structure.
Figure 46:
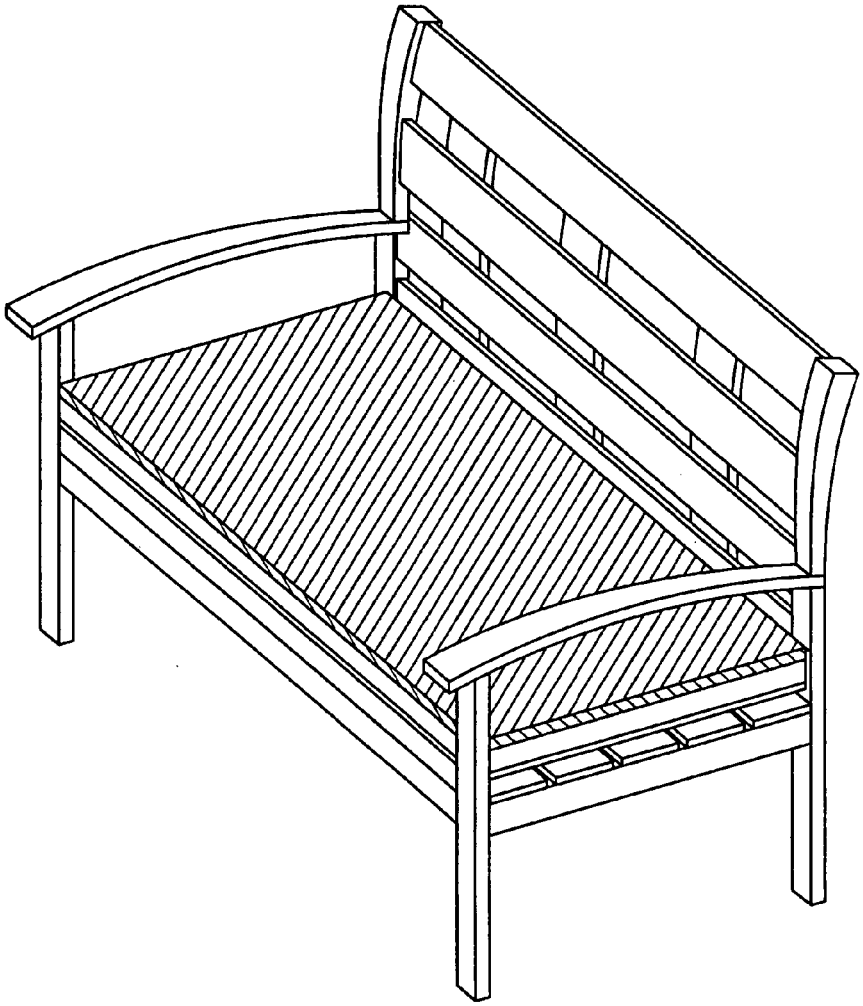
FIG. 46 is a diagram of one embodiment of a slipcover for covering an outdoor bench seating structure.

FIGS. 45-46 show embodiments of a slipcover that covers outdoor seating structures. Slipcovers for outdoor seating structures can include materials that provide resistance and protection from ultraviolet radiation and/or water-resistant or waterproof materials that protect the seating structure from rain.

Accordingly, what has been described are slipcovers that include various features and components and that can be used to cover a variety of seating structures. One skilled in the art will appreciate that any embodiment described and/or illustrated herein is exemplary and does not limit the scope of the invention as defined by the following claims.

What is claimed is:

1. A slipcover for covering at least a portion of a seating structure, comprising:

a fabric sheet configured to cover at least a portion of the seating structure, wherein the fabric sheet substantially conforms to the seating structure when applied and is removably secured thereto; and at least one of:

at least one fastener attached to the fabric sheet for releasably securing a multi-layered component to at least one selected portion of the fabric sheet, wherein the at least one selected portion comprises less than the entire fabric sheet, and a multi-layered component releasably secured to the fabric sheet, wherein the multi-layered component comprises:

a shaped edge;

a top layer of fabric, and a layer of cushioning material that at least partially corresponds to said shaped edge.

2. The slipcover of claim 1, wherein the top layer of fabric is secured to the fabric sheet.

3. The slipcover of claim 1, wherein the multi-layered component is configured so that the layer of cushioning material is removable from the multi-layered component.

4. The slipcover of claim 1, further comprising a second fastener for attaching to at least one of: a fastener on another slipcover and a fastener on a portion of another slipcover.

5. The slipcover of claim 1, wherein, for a seating structure that accommodates multiple users, the fabric sheet is configured to at least partially cover a one-user portion of the seating structure.

6. The slipcover of claim 1, wherein the at least one fastener is secured to a portion of the fabric sheet corresponding to at least one of: a seat portion, a back portion, an arm portion, a skirt portion, and a foot rest portion of the seating structure.

7. The slipcover of claim 1, wherein the multi-layered component is secured to a portion of the fabric sheet corresponding to at least one of: a seat portion, a back portion, an arm portion, a skirt portion, and a foot rest portion of the seating structure.

8. The slipcover of claim 1, wherein, for a seating structure that accommodates more than two users, the fabric sheet is configured to at least partially cover a two-user portion of the seating structure.

9. The slipcover of claim 1, further comprising:

a removable multi-layered component having a second fastener for interacting with the at least one fastener on the fabric sheet to secure the removable multi-layered component to the fabric sheet.

10. The slipcover of claim 1, wherein the at least one fastener includes at least one of: a zipper, a button and a button hole, a snap, a tie, a hook, a buckle, a D-ring, a clip, a strap, and a hook-and-loop type fastener.

11. The slipcover of claim 1, wherein the multi-layered component is secured to the fabric sheet by at least one of: applying fasteners, applying friction, and applying friction from a friction enhancing material.

12. Furniture, comprising:

a seating structure comprising:

a first seating structure portion, and at least one other seating structure portion;

a first slipcover according to claim 1, said first slipcover at least partially covering the first seating structure portion; and a second slipcover according to claim 1, said second slipcover at least partially covering one of the at least one other seating structure portions.

13. A slipcover for covering at least a portion of a seating structure, the slipcover comprising:

a fabric sheet that substantially conforms to the seating structure when applied and is removably secured thereto; and a multi-layered component releasably secured to the fabric sheet and comprising:

a shaped edge;

a top layer of fabric, and a layer of cushioning material that at least partially corresponds to said shaped edge, wherein the multi-layered component is capable of being opened to access the layer of cushioning material.

14. The slipcover of claim 13, wherein the seating structure comprises at least one cushion, and the fabric sheet covers the entirety of the at least one cushion.

15. The slipcover of claim 13, wherein the multi-layered component is secured to a portion of the fabric sheet corresponding to at least one of: a seat portion, a back portion, an arm portion, a skirt portion, and a foot rest portion of the seating structure.

16. The slipcover of claim 13, further comprising at least one fastener for attaching to at least one of: a fastener on another slipcover and a fastener on a portion of another slipcover.

17. The slipcover of claim 13, further comprising an extension that is secured to the multi-layered component.

18. The slipcover of claim 17, wherein, if the seating structure has a crevice, the extension is inserted into the crevice of the seating structure together with an end portion of the fabric sheet, and wherein the multi-layered component is secured to the fabric sheet by pressure and friction between the extension and the end portion of the fabric sheet in the crevice.

19. The slipcover of claim 13, wherein the top layer of fabric is secured to the fabric sheet by decouplable fasteners.

20. The slipcover of claim 13, wherein the multi-layered component further comprises a bottom layer of fabric, wherein the top layer of fabric and the bottom layer of fabric are at least partially secured to each other by decouplable fasteners.

21. The slipcover of claim 13, wherein the multi-layered component is capable of containing more than one layer of cushioning material.

22. A multi-layered component capable of being releasably secured to a slipcover having at least one fastener, the multi-layered component comprising:

a shaped edge;

a top layer of fabric;

a bottom layer of fabric secured to the top layer of fabric;

a layer of cushioning material between the top layer of fabric and the bottom layer of fabric, wherein the layer of cushioning material at least partially corresponds to said shaped edge; and at least one fastener for releasably coupling to corresponding at least one fastener on the slipcover.

23. The multi-layered component of claim 22, wherein the at least one fastener includes at least one of: a zipper, a button and a button hole, a snap, a tie, a hook, a buckle, a D-ring, a clip, a strap, and a hook-and-loop type fastener.

24. The multi-layered component of claim 22, wherein the at least one fastener is attached to at least one of: the top layer of fabric and the bottom layer of fabric.

25. The multi-layered component of claim 22, wherein the multi-layered component is configured so that the layer of cushioning material is removable from the multi-layered component.

26. The slipcover of claim 1, wherein the seating structure comprises at least one cushion, and the fabric sheet covers the entirety of the at least one cushion.

* * * * *